US005121170A

United States Patent [19]

Bannai et al.

[11] Patent Number: 5,121,170

[45] Date of Patent: Jun. 9, 1992

[54] DEVICE FOR TRANSPORTING SHEET MEMBERS USING AN ALTERNATING VOLTAGE

[75] Inventors: Kazunori Bannai, Yokohama; Noriyuki Kimura, Kawasaki; Hideya Furuta, Yokohama; Kenichi Mizuma, Yokohama; Katsuo Sakai, Yokohama; Kazusige Taguchi, Warabi; Mitsuru Mamizuka; Yoshihiro Sakai, both of Tokyo, all of Japan

[73] Assignee: Ricoh Company, Ltd., Tokyo, Japan

[21] Appl. No.: 645,503

[22] Filed: Jan. 24, 1991

Related U.S. Application Data

[63] Continuation-in-part of Ser. No. 518,950, May 4, 1990, abandoned.

[30] Foreign Application Priority Data

| | | | |
|---|---|---|---|
| May 12, 1989 | [JP] | Japan | 1-117374 |
| Dec. 19, 1989 | [JP] | Japan | 1-327324 |
| Jan. 24, 1990 | [JP] | Japan | 2-12477 |
| Feb. 26, 1990 | [JP] | Japan | 2-42695 |
| Mar. 13, 1990 | [JP] | Japan | 2-59991 |
| Mar. 26, 1990 | [JP] | Japan | 2-75850 |
| Oct. 4, 1990 | [JP] | Japan | 2-265268 |

[51] Int. Cl.[5] ..... B65H 5/08; G03G 15/01

[52] U.S. Cl. ..... 355/326; 271/193; 271/275; 198/671; 355/309

[58] Field of Search ..... 271/193, 18.1, 275; 198/691; 355/326, 308, 309

[56] References Cited

U.S. PATENT DOCUMENTS

| | | | |
|---|---|---|---|
| 2,576,882 | 11/1951 | Koole et al. | 198/691 |
| 3,493,157 | 2/1970 | Burdorf et al. | 198/691 |
| 4,244,465 | 1/1981 | Hishikawa et al. | 271/193 |
| 4,526,357 | 7/1985 | Kuehnle et al. | 271/193 |
| 4,856,769 | 8/1989 | Andrew et al. | 271/193 |
| 4,864,461 | 9/1989 | Kasahara | 271/193 |
| 4,978,118 | 12/1990 | Kasahara | 271/193 |
| 5,003,325 | 3/1991 | Bibl | 271/193 |
| 5,019,871 | 5/1991 | Takeda et al. | 271/193 |

OTHER PUBLICATIONS

Martellock, A. "Adhering and Releasing Documents From Pelts", *Xerox Disclosure Journal*, vol. 3, No. 1, p. 43, Jan./Feb. 1978.

Hoisington, P. "Electrostatic Document Transports", *Xerox Disclosure Journal*, vol. 4, No. 3, p. 335, May/Jun. 1979.

*Primary Examiner*—Robert P. Olszewski
*Assistant Examiner*—Steven M. Reiss
*Attorney, Agent, or Firm*—Oblon, Spivak, McClelland, Maier & Neustadt

[57] ABSTRACT

A device for use in electrostatographic image recording equipment for retaining and transporting a paper sheet, document or similar sheet member. A transporting member is implemented as an endless belt. An AC voltage is applied to the belt to form a charge density pattern on the surface of the belt, while the charge density pattern sets up a non-uniform electric field in close proximity to the surface of the belt. The non-uniform electric field urges the sheet member against the belt and thereby allows it to be surely transported by the belt to a predetermined position without being dislocated.

25 Claims, 19 Drawing Sheets

DEVICE FOR TRANSPORTING SHEET MEMBERS USING AN ALTERNATING VOLTAGE

CROSS REFERENCE TO RELATED APPLICATION

This application is a continuation-in-part of copending U.S. application Ser. No. 07/518,950, filed May 4, 1990 now abandoned.

BACKGROUND OF THE INVENTION

The present invention relates to a device for transporting sheet members or similar members and, more particularly, to a device for use in electrostatographic image recording equipment for retaining and transporting a sheet member such as a paper sheet or a document.

Image recording equipment of the type using an electrostatographic process may be implemented as a color copier in which toner images sequentially formed in different colors on a single photoconductive element are transferred one after another to the same position on a paper sheet and then fixed to produce a color copy, as well known in the art. In this type of color copier, a paper sheet is repetitively transported a plurality of times to an image transfer station adjoining the photoconductive element, or it is wrapped round a transfer drum located at the transfer station and rotated a plurality of times by the drum. Another type of color copier uses a plurality of photoconductive elements and forms a toner image of different color on each of the photoconductive elements at a particular timing. Specifically, the plurality of photoconductive elements are arranged side by side, and a paper sheet is sequentially transported through transfer stations each being associated with respective one of the photoconductive elements. In either one of such conventional color copiers, a paper sheet being transported through the single transfer station or sequentially through the plurality of transfer stations carries a toner image non-fixed thereon. It is impossible, therefore, to transport the paper sheet by nipping it by a transport roller pair. Furthermore, a copier, whether it be a color copier or a black-and-white or similar monochromatic copier, has a fixing device having a fixing roller in which a heater is accommodated. To prevent heat generated by the heater from deteriorating the photoconductive element, the fixing device is spaced apart by a substantial distance from the transfer station which adjoins the photoconductive element. The paper sheet carrying the non-fixed toner image is transported over such a distance.

It has been customary to transport a paper sheet carrying a non-fixed toner image by using a rotatable endless belt. Specifically, the endless belt transports the paper sheet while retaining the paper sheet face up in close contact with its surface. To transport a paper sheet or similar sheet member in this fashion, there has been used some different systems, as follows.

(1) Air Suction System

An endless belt formed with a number of apertures therethrough or a plurality of juxtaposed belts are used. Air is sucked through the apertures of the belt or the clearance between nearby belts into a suction box which is disposed between the upper and lower runs of the belt or those of each belt, whereby a sheet member is firmly retained on the belt or belts. This kind of scheme has a drawback that a pneumatic pump and a conduitwork is needed for sucking air, resulting in a bulky transporting device.

(2) Gripper System

A belt is provided with a gripper so that it may transport a sheet member while retaining it thereon with the gripper. This system cannot transport a plurality of sheets members continuously at high speed because the operation timing of the gripper has to be controlled. Moreover, when the gripper fails to grip a sheet member, the sheet member jams the transport path.

(3) Electrical Double Layer System

This system is often used with a transfer belt of an electrostatographic image recording system. Specifically, an electrical double layer is developed in a layer including a belt and a sheet member by corona charge, for example, so that the belt may transport a sheet member while electrostatically retaining it thereon. The electrical double layer developed by the first corona charge successfully retains the first sheet member on the belt. However, once the sheet member is separated from the belt, the belt loses the retaining force. Furthermore, since a charge remains on the belt even after the separation of the paper sheet, the belt has to be discharged and then charged again before the transport of the second sheet member. For these reasons, the electrical double layer scheme is not practical.

(4) Buried Comb Electrode System

A buried comb electrode system is extensively applied to a pen plotter, for example, for the purpose of retaining a sheet member. Specifically, two comb electrodes are buried in a dielectric belt such that their teeth mate each other. A positive and a negative voltage are applied to the individual comb electrodes. This approach increases the production cost and cannot be easily practiced with an endless belt. Further, since a transfer belt incorporated in electrostatographic recording equipment is usually provided with another electrode therein, the comb electrodes lower the image transfer efficiency and causes irregular image transfer to occur. In addition, the comb electrodes are not durable because they are easy to snap.

An ADF (Automatic Document Feeder) is another implementation usable with electrostatographic image recording equipment for transporting a sheet member. Specifically, an ADF automatically transports a document to a predetermined position on a glass platen which is included in a copier or a document reader. A transport belt included in an ADF is usually implemented as a rubber belt having a large coefficient of friction and pressing a document against the glass platen while in movement. A problem with the rubber belt is that its surface is susceptible to contamination due to contact with the document and glass platen, and the contamination is difficult to remove. When a tracing paper or a thin paper highly pervious to light is used as the document, even the contamination on the rubber belt is read and exposed to critically degrade the quality of reproductions. To free the belt surface from such contamination, it has been proposed to introduce an anti-contamination agent in the material of the belt, to apply anti-contamination oil to the belt, or to use a cleaning blade. Such schemes are in practice not satisfactory and are not durable.

The transport belt made of rubber may be replaced with electrostatic adhesion, as also proposed in the art.

For example, an endless belt installed in an ADF may be implemented as an insulative belt in which a pattern electrode is buried, as disclosed in Japanese Patent Laid-Open Publication (Kokai) 116825/1978. A voltage is applied to the pattern electrode to retain a document on the belt by an electrostatic force. However, it is difficult to bury the pattern electrode in an endless belt, while a device for applying a high voltage to such a belt is complicated and expensive. Moreover, since the endless belt with the pattern electrode bends at the positions where it is passed over rollers, the pattern electrode is apt to snap and its feed section is apt to wear. This is undesirable from the durability standpoint.

A transporting device may be provided with a charging unit for charging a document transport belt and a device for adjusting the clearance between the transport belt and the glass platen of a copier, as taught in Japanese Patent Laid-Open Publication No. 288843/1988. With this device, it is possible to implement two different functions at the same time, i.e., a function of transporting a document through a comparatively narrow clearance as usual and a function of transporting a document by electrostatically retaining it on the charged document through a comparatively wide clearance. A drawback with this type of device is that since the belt is charged by a DC voltage, the resultant uniform charge cannot exert an intense retaining force. For example, it is difficult to retain the entire surface of a paper sheet of format A3 on the belt and, therefore, to transport it while spacing it apart from the glass platen.

Japanese Patent Laid-Open Publication No. 288844/1988 discloses a device in which the surface of a transport belt which contacts a desired object is constituted by a film-forming layer of amorphous silicone. This device is elaborated to free the surface of the belt from contamination and to allow the belt to transport a desired object while electrostatically retaining it on the amorphous silicone layer having been charged. However, depositing amorphous silicone on a conductive substrate increases the production cost. Another drawback is that since amorphous silicone is photoconductive, the electrostatic retaining force achievable therewith is susceptible to light. Specifically, when such a belt is used as a transport belt of an ADF, the charge or retaining force of the amorphous silicone layer changes from time to time after the illumination of a document, depending on the kind of paper and the number of copies produced. It is likely, therefore, that a document jams the transport path when it is driven out of the ADF.

Japanese Patent Laid-Open Publication No. 28016/1980 proposes a system in which a charge pattern is formed on a transport belt so as to retain and transport a sheet by electrostatic attraction. This system, however, does not give consideration to the position where a sheet should be fed to a transport belt, i.e., positioning of the belt and a sheet. Further, such a conventional implementation cannot exert a sufficient transporting force on a sheet.

A color copier of the type transferring an image to a sheet by use of a transfer drum is disclosed in Japanese Patent Laid-Open Publication No. 11958/1987. The transfer drum is rotated once while a photoconductive element is rotated twice, so that a sheet can be positioned with accuracy. However, the drawback with this color copier is that since it clamps a leading edge portion of a sheet, an image cannot be transferred to the leading edge portion and, in addition, it is not easy to transfer images to post cards or similar relatively thick sheets.

A system having a plurality of photoconductive drums for forming and transferring images of different colors one after another in synchronism with the movement of a sheet is shown and described in Japanese Patent Laid-Open Publication Nos. 145261/1987 and 11965/1988. With such a system, however, it is difficult to provide all the photoconductive elements with the same radius. Moreover, the system needs a complicated arrangement since an image has to be transferred when a photoconductive element completes an integral number of rotations.

In color image forming equipment, a sheet retained on transporting means may be moved back and forth to transfer images sequentially thereto at an image transfer position of an image carrier, as disclosed in Japanese Patent Laid-Open Publication No. 118366/1987. While in a forward or image transferring movement, the sheet retained on the transforming means has a leading edge portion thereof separated from the transporting means. When the sheet is moved backward and held in a waiting position before the transfer of the next image, a trailing edge portion thereof is separated from the transporting means. That is, the sheet is partly separated from the transporting means before and after an image transferring step. This is successful in reducing the dimensions of the transporting means and, therefore, the overall dimensions of the equipment. However, when a plurality of images are transferred to a sheet one upon another, it is likely that the sheet is dislocated relative to the transporting means to bring the images of different colors out of register, thereby obstructing high quality image reproduction. To eliminate the dislocation of the sheet, a belt implementing the transporting means may be charged in a portion thereof which has been spaced apart from the sheet in order to increase the sheet retaining force. This kind of countermeasure, however, brings about other various drawbacks, as follows. When the next image is to be transferred, the surface potential of the belt differs from the portion having been separated from the sheet previously to the other portion. Since the required current sequentially increases as the image transferring step is repeated, the surface potential increases to change the transfer efficiency each time and, therefore, the resultant image suffers from an irregular density distribution.

SUMMARY OF THE INVENTION

It is therefore an object of the present invention to eliminate the drawbacks particular to the prior art sheet member transporting device as discussed above.

It is another object of the present invention to provide a sheet member transporting device capable of surely retaining and transporting a sheet member by a simple construction, while positioning the sheet member accurately relative to transporting means thereof.

It is another object of the present invention to provide a sheet member transporting device which is inexpensive, compact, and durable.

It is another object of the present invention to provide a generally improved sheet member transporting device.

In accordance with the present invention, a device for transporting a sheet member having a substantial area has an endless transport belt made of a dielectric material for transporting the sheet member by contacting and retaining the sheet member thereon. The transport belt is passed over and supported by a pair of roller means. The pair of roller means comprise a drive roller for driving the transport belt in a reciprocating motion and a conductive driven roller connected to ground. An electrode contacts the transport belt and faces the driven roller with the intermediary of the transport belt for forming, when the transport belt is in a forward movement and a backward movement, a charge density pattern on a portion of the transport belt which is separated from the sheet member. A voltage source applies an AC voltage to the electrode.

Further, in accordance with the present invention, in image forming equipment having a device for transporting a paper sheet by retaining it thereon by attraction in order to transfer a plurality of developed images from an image carrier to the paper sheet one upon another, the device has a transport belt made of a dielectric material for transporting the paper sheet to an image transfer position by retaining the sheet. The transport belt is passed over and supported by a pair of roller means. The roller means comprise a drive roller for driving the transport belt in a reciprocating motion and a conductive roller connected to ground. An electrode contacts the transport belt and faces the conductive roller with the intermediary of the transport belt for forming, when the transport belt is in a forward and a backward movement, a charge density pattern due to a non-uniform electric field in a portion of the transport belt which is separated from the paper sheet. A voltage source applies an AC voltage to the electrode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
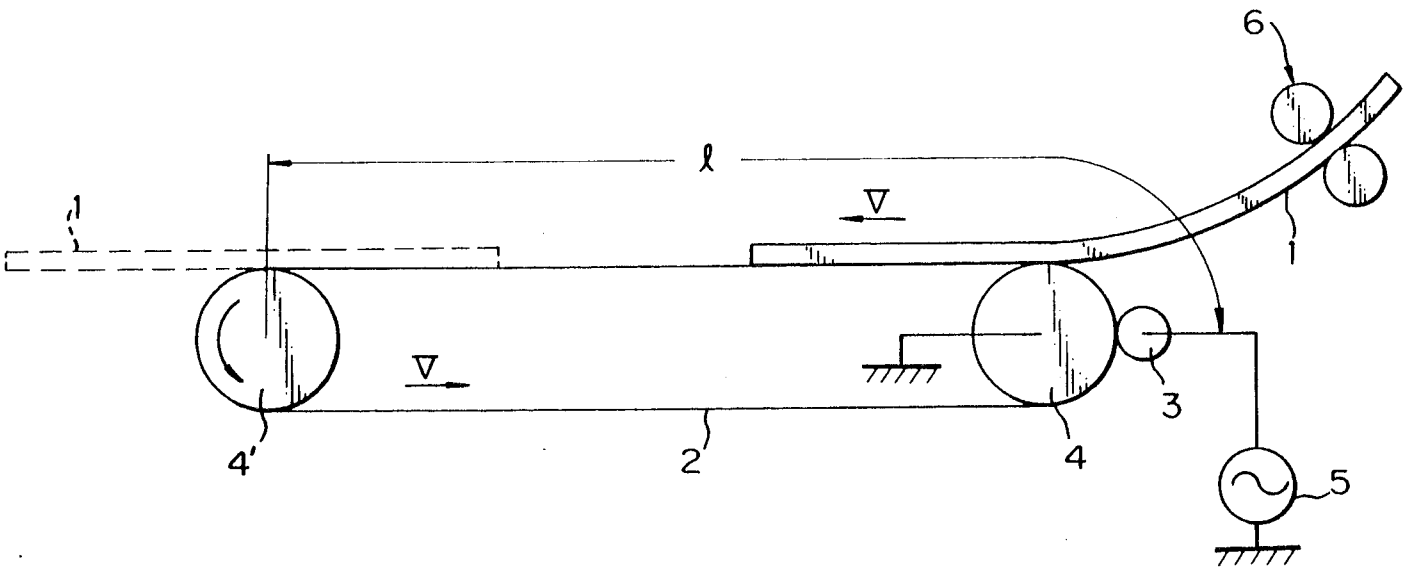
FIG. 1 is a sectional side elevation schematically showing the basic construction of a sheet member transporting device embodying the present invention.
Figure 2A:
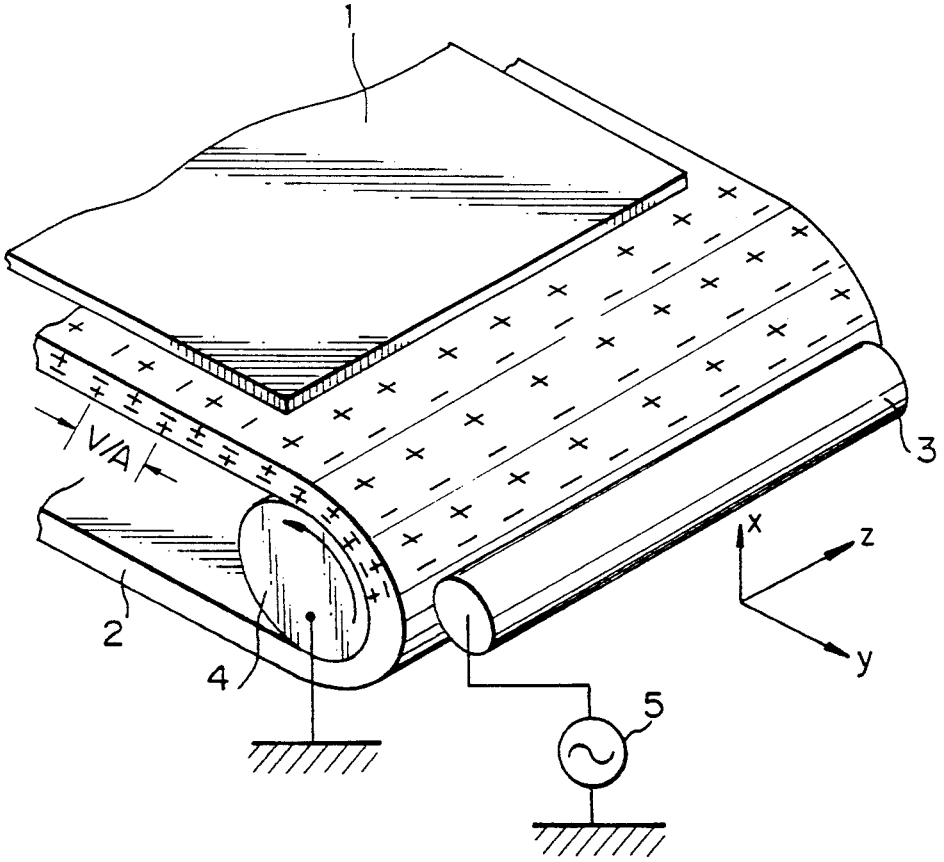
FIGS. 2A, 2B and 3 are views useful for understanding the operation of the illustrative embodiment.
Figure 2B:
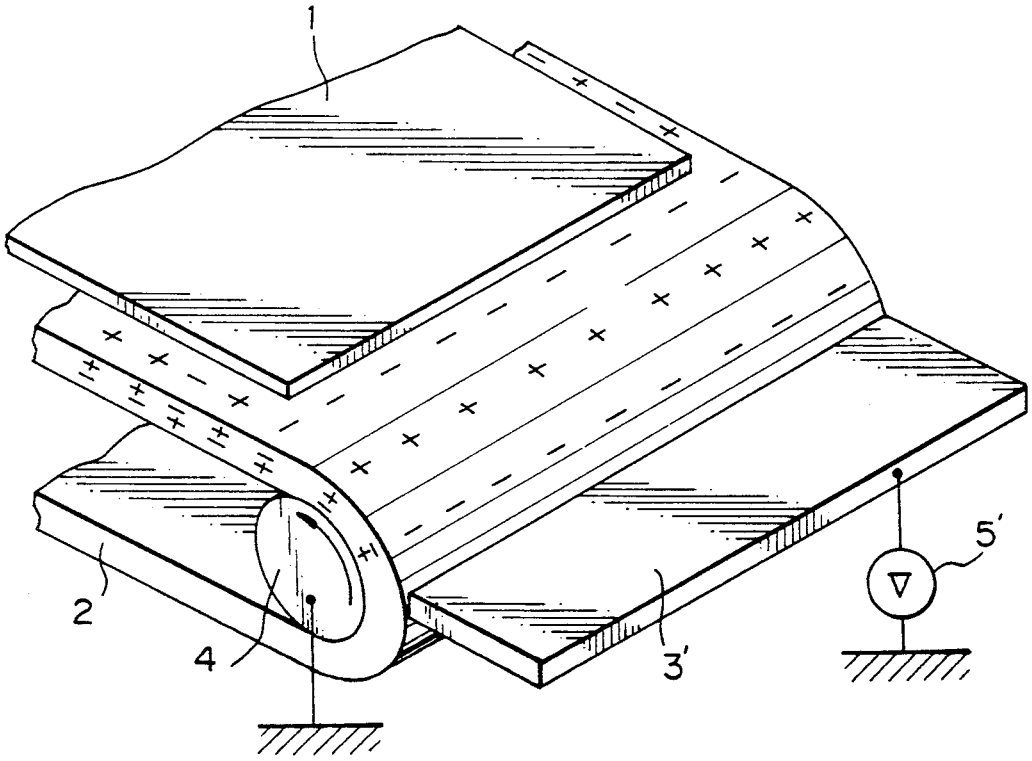

Referring to FIG. 1 of the drawings, the basic construction of a transporting device embodying the present invention is shown schematically. As shown, a transport belt 2 for transporting a paper sheet or similar sheet member 1 is implemented as an endless belt and passed over a support roller 4 and a drive roller 4'. The support roller 4 is made of metal and connected to ground. As shown in FIG. 2A, a roller 3 is held in contact with the outer periphery of a part of the belt 2 which is passed over the support roller 4. The roller 3 forms a charge density pattern on the belt 2, as will be described. An AC power source 5 applies an AC voltage having a frequency of A hertz to the roller 3 and, in this sense, the support roller 4 plays the role of a counter electrode. As shown in FIG. 2B, the roller 3 may be replaced with a blade-like electrode 3' the edge of which is held in sliding contact with the outer periphery of the belt 2 in the same position as the roller 3.

The drive roller 4' drives the belt 2 at a constant speed of V mm per second in a direction indicated by an arrow in the figures. The sheet 1 is fed to the belt 2 at a position downstream of the position where the electrode 3 contacts the belt 2 with respect to the direction of movement of the belt 2 and in a range where the belt 2 contacts the support roller or counter electrode 4, as indicated by P in FIG. 1. Hence, the register roller 6 is positioned such that the sheet 1 is fed to the position P. In this configuration, the AC voltage is applied from the AC power source 5 to the belt 2 via the electrode 3 before the sheet 1 reaches the belt 2. Consequently, a charge density pattern having charge densities $-\sigma$ and $+\sigma$ alternating with each other at the pitch of V/A mm is formed on the surface of the belt 2. A similar charge density pattern is formed on the inner periphery of the belt 2 in a phase which is deviated by 180 degrees from the phase of the above-mentioned charge density pattern.

Figure 3:
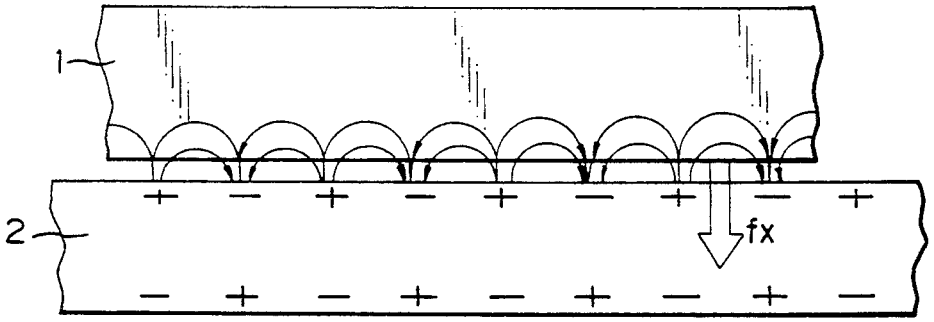

As shown in FIG. 3, the charge density patterns provided on the opposite surfaces of the belt 2 as stated above form a non-uniform electric field in close proximity to the surface of the belt 2. A force acting on the unit volume of the sheet or dielectric 1 due to the non-uniform electric field is expressed by using Maxwell's stress tensor, as will be shown. Such a force has a component $f_x$ which is perpendicular to the surface of the sheet 1 and electrostatically urges the sheet 1 against the belt 2. The sheet 1 is, therefore, surely retained on and transported by the belt 2 without being dislocated.

Assume that a direction perpendicular to the surface of the sheet 1 is x, a direction in which the sheet 1 is transported is y, and a direction perpendicular to the direction y on the sheet 1 is z. Then, the force acting on the unit volume of the sheet or dielectric 1 has components $f_x$, $f_y$ and $f_z$ which act respectively in the directions x, y and z and are expressed as: Maxwell's stress tensor $$\begin{pmatrix} E_xD_x - \frac{1}{2}(E \cdot D) & E_xD_y & E_xD_z \\ E_yD_x & E_yD_y - \frac{1}{2}(E \cdot D) & E_yD_z \\ E_zD_x & E_zD_y & E_zD_z - \frac{1}{2}(E \cdot D) \end{pmatrix}$$

$$f_x = \frac{\partial}{\partial x}\left\{ E_xD_x - \frac{1}{2}(E \cdot D) \right\} + \frac{\partial}{\partial y}(E_xD_y) \div \frac{\partial}{\partial z}(E_xD_z)$$

$$f_y = \frac{\partial}{\partial x}(E_yD_x) + \frac{\partial}{\partial y}\left\{ E_yD_y - \frac{1}{2}(E \cdot D) \right\} \div \frac{\partial}{\partial z}(E_yD_z)$$

$$f_z = \frac{\partial}{\partial x}(E_zD_x) + \frac{\partial}{\partial y}(E_zD_y) \div \frac{\partial}{\partial z}\left\{ E_zD_z - \frac{1}{2}(E \cdot D) \right\}$$

where E and D are the electric field and the dielectric flux density, respectively, and the suffixes x, y and z are representative of the directions.

The voltage applied to the belt 2 may be implemented by a DC component superposed on an AC voltage.

As shown in FIG. 2B, assume that a power source 5' for applying the voltage to the belt 2 is comprised of a power source which outputs a non-uniform alternating voltage, instead of the regular AC power source. Then, the non-uniform alternating voltage forms on the surface of the belt 2 a non-uniform charge density pattern in which a positively charged portion and a negatively charged portion alternate with each other at different pitches. A similar non-uniform charge density pattern which is opposite in polarity to the above-mentioned charge density pattern is formed on the back of the belt 2.

While the specific arrangements shown and described form a charge density pattern in a stripe configuration, such a configuration is only illustrative and may be replaced with checkers, for example. The sheet retaining and transporting ability stated above is insured with no regard to the configuration of the charge density pattern.

Figure 8:
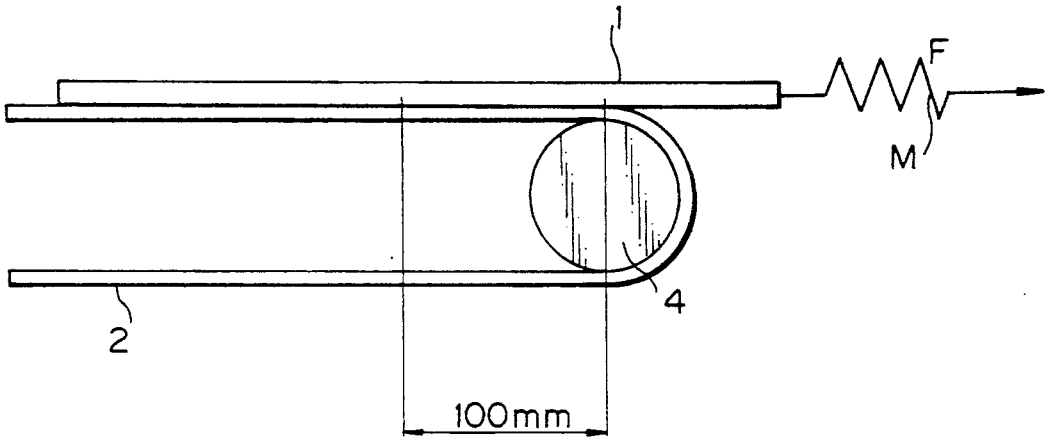
FIG. 8 is a sectional side elevation showing a specific arrangement for measuring the retaining force which the transporting device of the present invention exerts.

The sheet 1 is transported into contact with the belt 2 at the position P where the belt 2 is separated from the support roller 4. This allows the belt 2 to retain the sheet 1 by a great force, i.e., electrostatic attracting force. An experiment was conducted by applying an AC voltage having a frequency of 600 hertz and a peak voltage of 3 kilovolts to the electrode 3, driving the belt 2 at a linear velocity of 500 millimeters per second, and feeding a plain paper sheet of format A3 (longitudinal) to the belt 2. As shown in FIG. 8, a spring scale M was anchored to the trailing edge of the paper sheet. When the paper sheet contacted the belt 2 over a length of 100 millimeters, i.e., over an area of 300 $cm^2$, the electrostatic attracting force or retaining force was measured to be 2 kgf in terms of tensile strength. By contrast, as shown in FIG. 1, when the register roller pair 6 is so located as to feed the paper sheet 1 to a position P' much downstream of the position P, the sheet retaining force available with the belt 2 is noticeably reduced.

Figure 4:
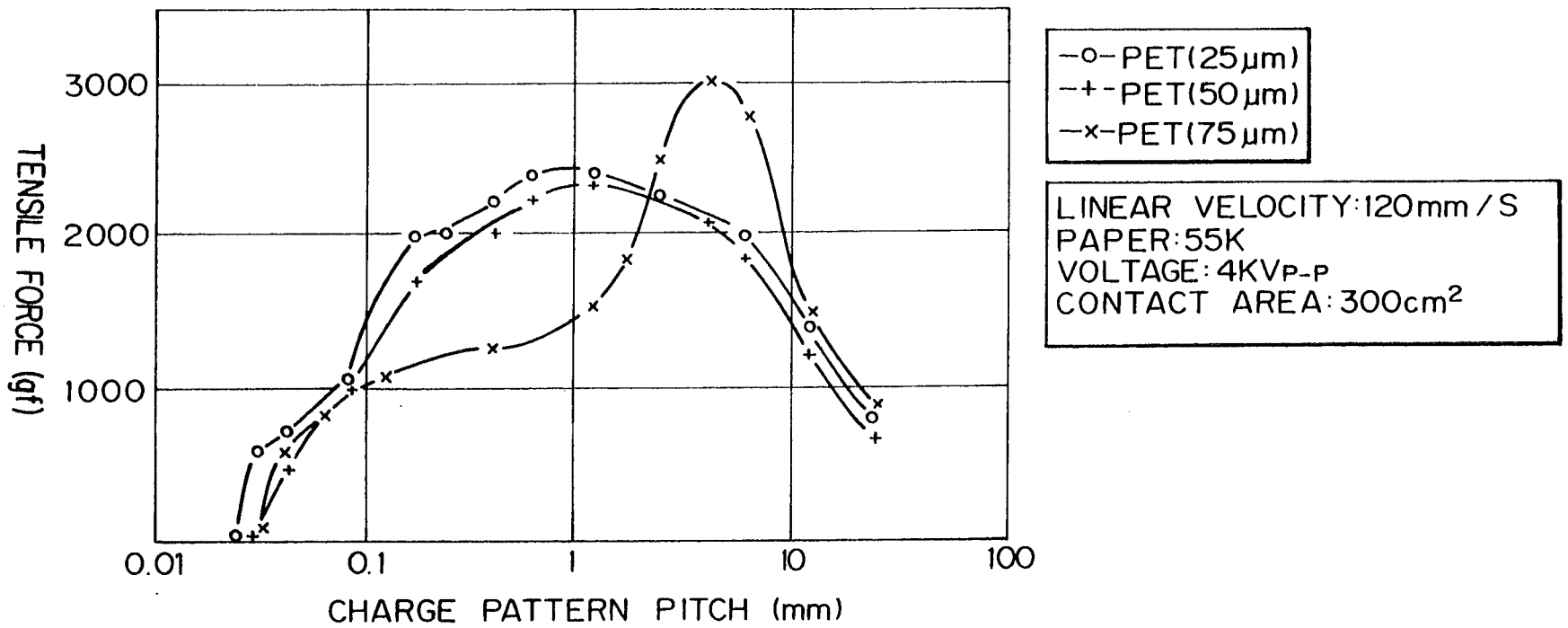
FIG. 4 is a graph showing a relationship between the pitch of a charge pattern and tensile force.
Figure 5:
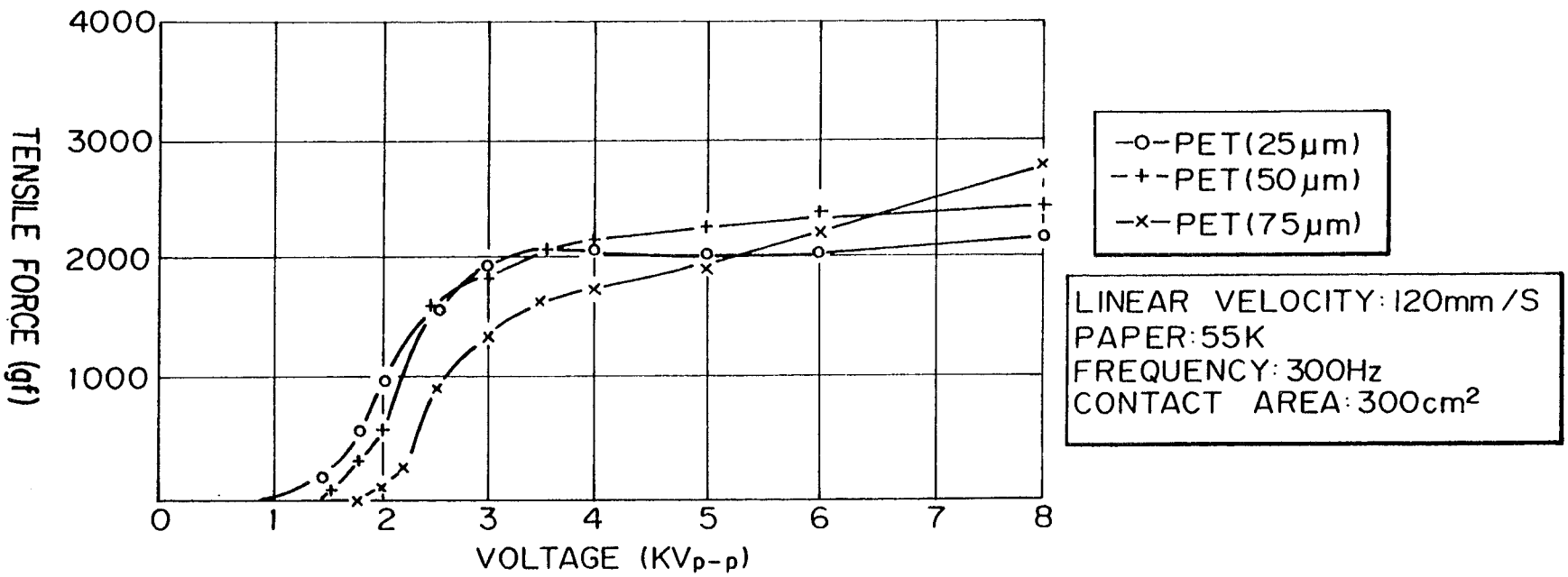
FIG. 5 is a graph showing a relationship between voltage and tensile force.

A relationship between the pitch of the charge pattern formed on the belt 2 and the retaining force, i.e., the tensile strength and a relationship between the voltage and the retaining force were experimentally determined by the specific method shown in FIG. 8 and by using belts each having a different thickness. The results of experiments are shown in FIGS. 4 and 5. Specifically, use was made of one-layer type belts having thicknesses of 25 μm, 50 μm and 75 μm and each being implemented as a PET (polyethylene terephthalate or Mylar) film. The belts were driven at a linear velocity of 120 mm/sec each. When the amplitude of the AC voltage applied to the individual belts was maintained constant (4 kVp-p) and the frequency was varied, the tensile force was varied as shown in FIG. 4. As FIG. 4 indicates, desirable tensile forces greater than 1 kg are achievable when the pitch of the stripe pattern is 0.1 mm to 20 mm. When the frequency was maintained constant (20 Hz) and the voltage was changed, the tensile force was measured as shown in FIG. 5. It will be seen that the belt which is 75 μm thick and easy to handle from the strength standpoint exhibits sufficient retaining forces when the voltage is higher than 2.5 kVp-p in terms of peak-to-peak value, but the voltage at which the retaining force begins to act becomes lower as the belt becomes thinner. At the voltages which did not generate the retaining force, no electric density patterns were formed on the belts. Thus, the experiments showed that the belt needs a voltage which is at least higher than the charge starting voltage, and that a desirable retaining force is achievable when the voltage is increased by more than 500 Vp-p in terms of peak-to-peak value above the charge starting voltage.

EXAMPLE 1

A transporting device constructed as shown in FIG. 1 is applied to image recording equipment of the type using an electrostatographic process. The transport belt 2 is implemented as a one-layer type high-resistance PET film (75 μm thick) and rotatably passed over the drive roller 4' and support roller 4. The support roller 4 is made of metal and connected to ground. The electrode 3 in the form of a roller is held in contact with the outer periphery of the belt 2 at the position where the belt 2 is passed over the support roller 4. An alternating voltage of 4 kVp-p and 60 Hz is applied from the AC power source 5 to the electrode 3. The belt 2 is driven at a constant speed of 120 mm/sec. The paper sheet 1 is fed to the belt 2 at a position downstream of the position where the electrode 3 contacts the belt 2 and in a range wherein the belt 2 contacts the support roller 4. The belt 2 transports the paper sheet 1 over a distance of 240 mm. In this configuration, the AC power source 5 applies the alternating voltage to the belt 2 via the electrode 3 before the paper sheet 1 reaches the belt 2, whereby a charge density pattern is deposited on the surface of the belt 2 at the pitch of 2 mm to retain the paper sheet 1 on the belt 2. The paper sheet 1 is separated from the belt 2 at a separating position where the drive roller 4' located at a separating position and then fed to a fixing unit by a guide.

Having a high resistance, the belt 2 of Example 1 does not allow the charge density pattern to easily disappear and, therefore, can transport a plurality of successive paper sheets 1. Nevertheless, since the charge density pattern remains unattenuated at the separating position, it is necessary to provide a pawl for separating the paper sheet 1 from the belt 2. Another example which does not need such a pawl will be described.

EXAMPLE II

The transport belt 2 is implemented as an endless belt which is 100 μm thick and comprised of a one-layer type dielectric film. The belt 2 is movably passed over the drive roller 4' and support roller 4. The dielectric film has a volume resistivity of $10^8$ Ω·cm and is constituted by a polyester film in which carbon is dispersed. The support roller 4 is made of metal and connected to ground. The electrode 3 in the form of a roller is held in contact with the outer periphery of the belt 2 at a position where the belt 2 is passed over the support roller 4. The AC power source 5 applies an alternating voltage of 4 kVp-p and 60 Hz to the electrode 3. The belt 2 is driven by the drive roller 4' at a constant speed (V) of 120 mm/sec as indicated by an arrow. The position where the paper sheet 1 is fed to the belt 2 is the same as in Example 1. The sheet separating position is located at a distance (l) of 240 mm from the electrode 3, so that the belt 2 having been charged by the electrode 3 reaches the separating position in 2 seconds (l/V). The AC power source 5 applies the alternating voltage to the belt 2 via the electrode 3 before the paper sheet 1 reaches the surface of the belt 2, whereby a charge density pattern is formed at the pitch of 2 mm on the surface of the belt 2 to retain the paper sheet 1 on the belt 2.

In Example 2, the belt 2 has a medium resistance and, therefore, the charge density pattern sequentially attenuates with the lapse of time. Assuming that the volume resistivity and specific inductivity capacity of the belt 2 are R and χ, respectively, the attenuation may be expressed in terms of surface potential V, as follows:

$$V = V_0 e^{-\frac{t}{\epsilon_0 x R}}$$

where $V_0$ and $\epsilon_0$ are the initial surface potential and the dielectric constant of vacuum.

Figure 6:
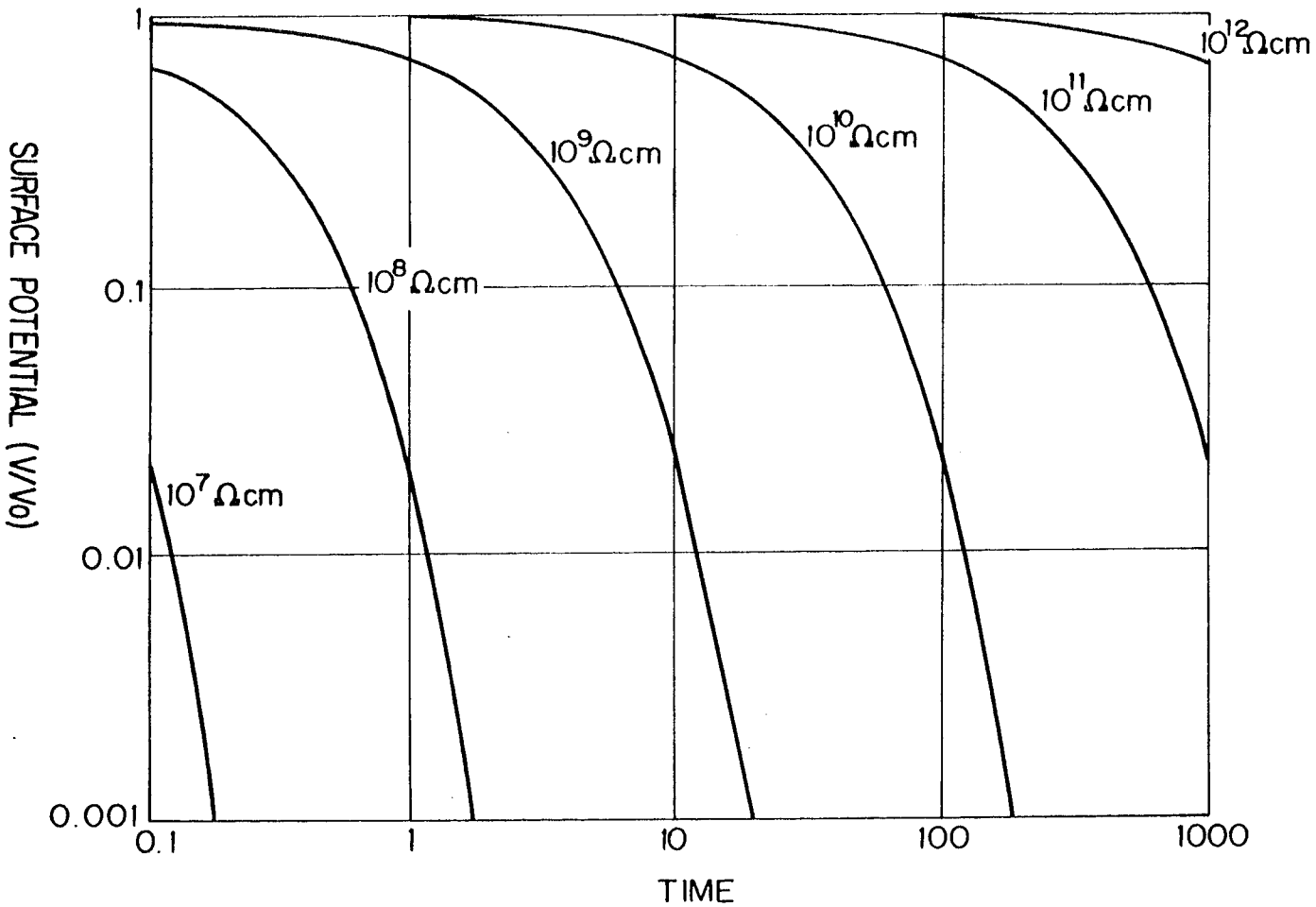
FIG. 6 is a graph showing a relationship between the attenuation of surface potential and time with respect to specific volume resistivities of a transport belt.
Figure 7:
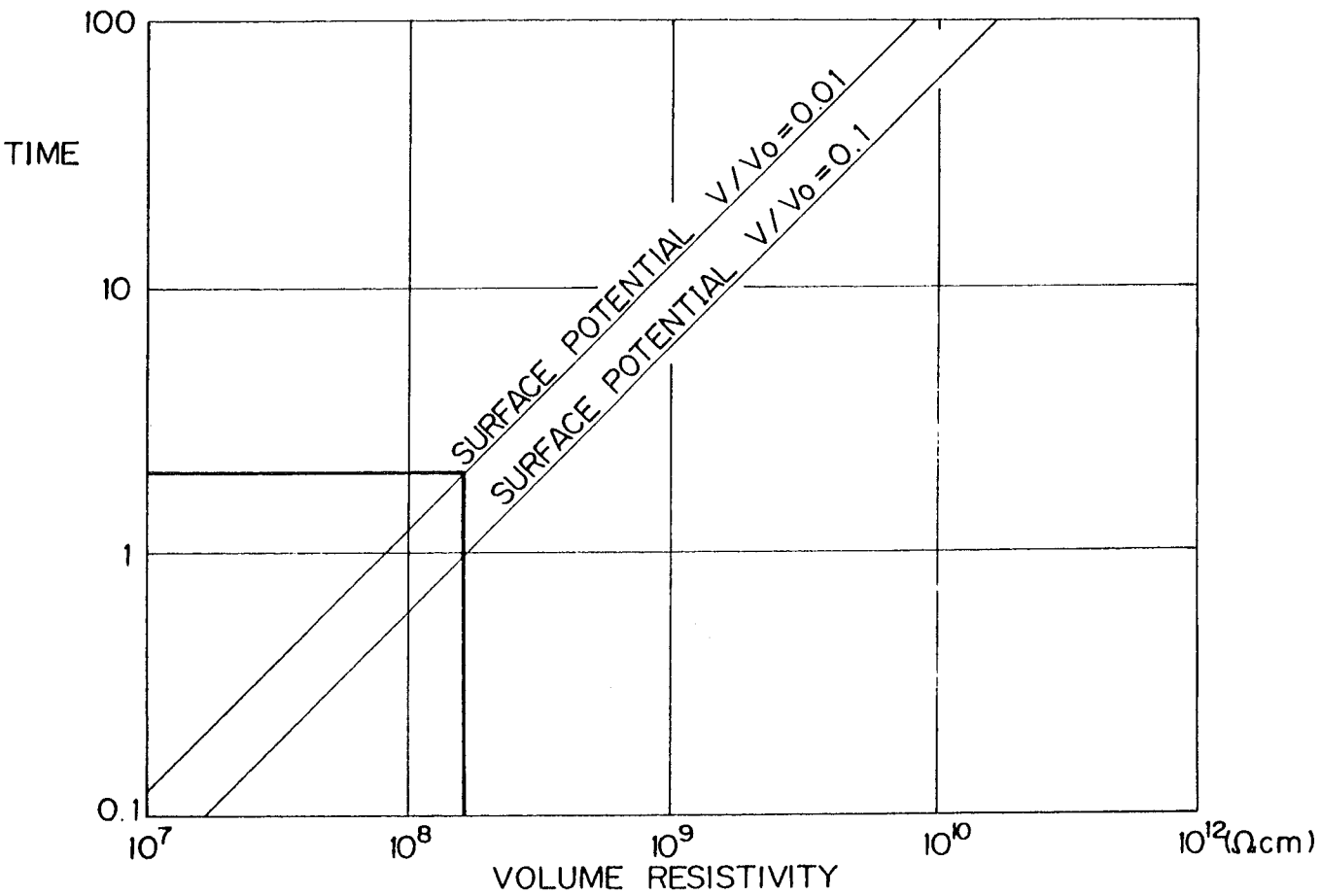
FIG. 7 is a graph representative of a relationship between volume resistivity and time observed when surface potential attenuates to predetermined ratios.

As the above equation indicates, the charge density pattern attenuates exponentially. FIG. 6 shows curves each being representative of the attenuation of surface potential caused by a particular volume resistivity and calculated with a dielectric constant χ of 3. FIG. 7 indicates a relationship between the volume resistivity and the time as measured when the surface potential is attenuated to 1/10 and 1/100. As shown, the surface potential is attenuated to 1/100 in 2 seconds when the volume resistivity is $1.64 \times 10$ Ω·cm. Hence, at the sheet separating position, the charge density pattern will have been substantially completely attenuated to promote easy separation of the paper sheet 1. This is successful in reducing the failure of sheet separation. It was experimentally found that the failure of sheet separation is suppressed even when a resistance which attenuates the surface potential to ½ is selected. The paper sheet 1 is separated from the belt 2 at the separating position where the drive roller 4' is located and then fed to a fixing unit by a guide.

Figure 9:
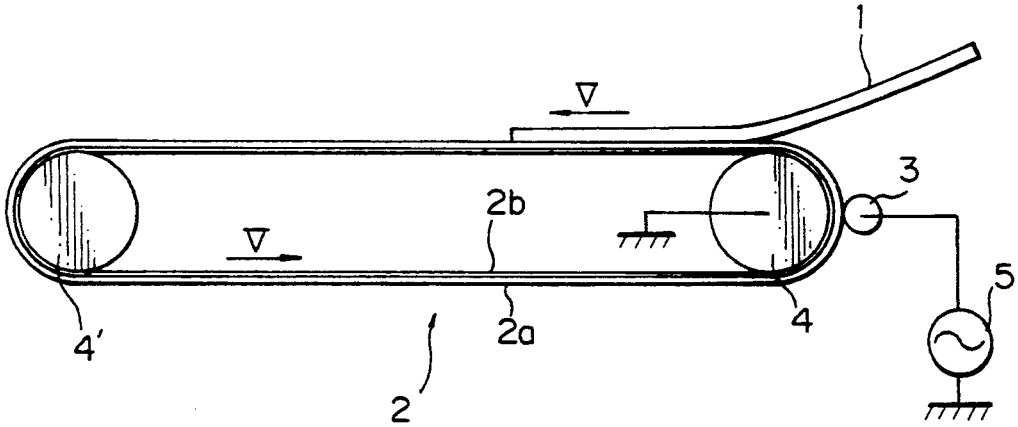
FIG. 9 is a sectional side elevation showing an alternative embodiment of the present invention.
Figure 10A:
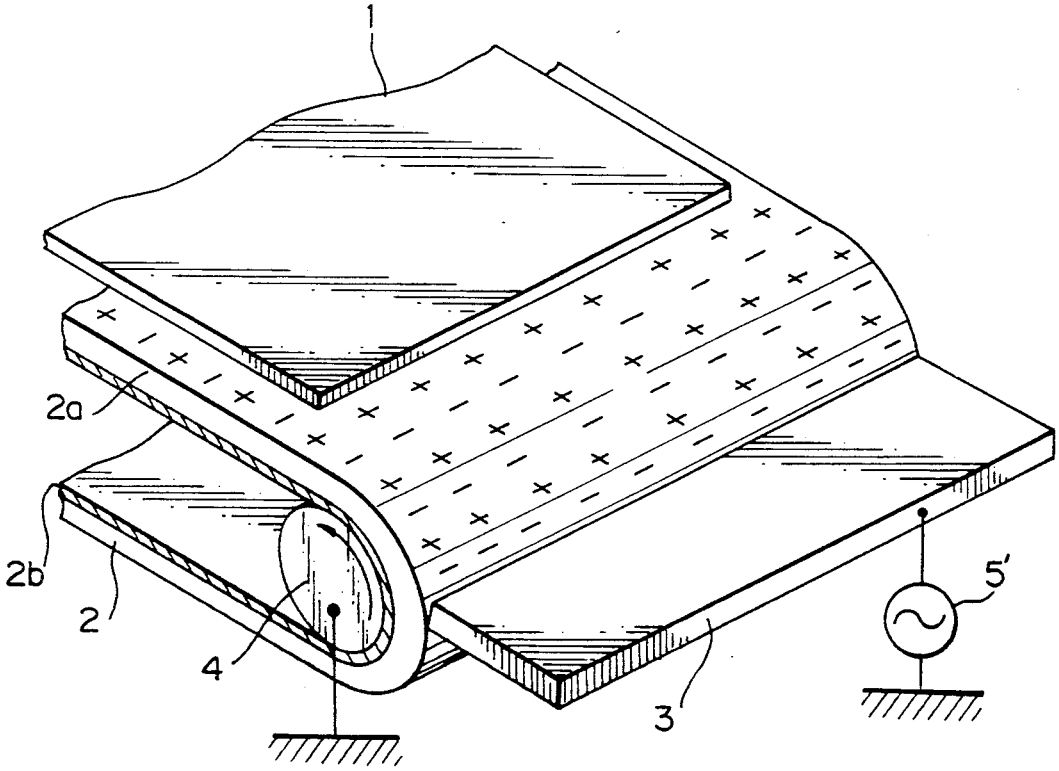
FIGS. 10A and 10B are views demonstrating the operation of the embodiment shown in FIG. 9.
Figure 10B:
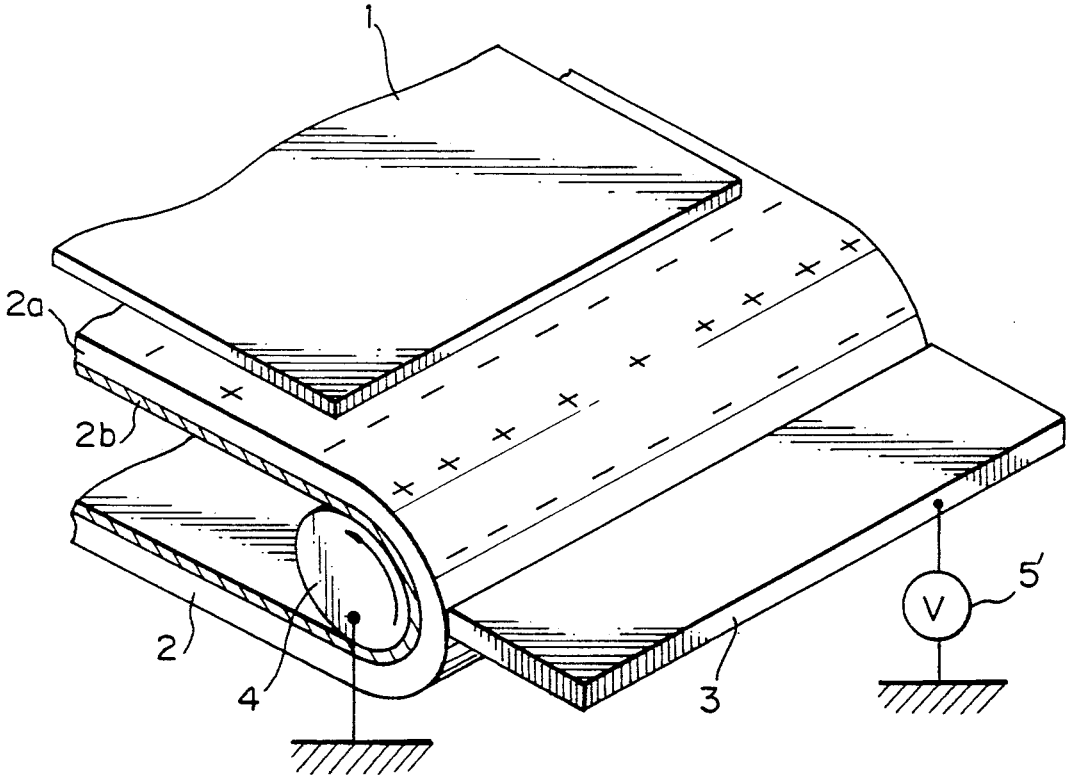

Referring to FIG. 9, the basic construction of an alternative embodiment of the transporting device in accordance with the present invention is shown. In the figures, the same components and structural elements are designated by like reference numerals, and redundant description will be avoided for simplicity. As shown, the transport belt 2 has a dielectric layer 2a and a conductive layer 2b which is formed over the entire inner surface of the dielectric layer 2a. The belt 2 is passed over the driver roller 4' and the support roller 4 which is made of metal and connected to ground, as in the previous embodiment. The electrode 3 is connected to the AC power source 5 and held in contact with the outer periphery of the belt 2 adjacent to the support roller 4. As shown in FIG. 10A, a positive-and-negative charge density pattern is provided regularly on the outer surface of the dielectric layer 2a of the belt 2. As shown in FIG. 10B, the power source 5 may be replaced with a power source 5' which outputs a non-uniform alternating voltage and thereby forms a non-uniform charge density pattern on the outer surface of the dielectric layer 2a. While the electrode 3 is shown as comprising a blade in FIGS. 10A and 10B, it may of course be replaced with a roller which contacts the belt 2.

The conductive layer 2b covers the entire inner periphery of the belt 2 and is connected to ground via the support roller 4. Hence, a charge pattern is also induced at the interface between the dielectric layer 2a and the conductive layer 2b. In this particular embodiment, it is not necessary that the position for feeding the paper sheet 1 lies in the range where the belt 2 is passed over the support roller 4, so long as it is located downstream of the position where the electrode 3 contacts the belt 2.

EXAMPLE III

The transporting device shown in FIG. 9 is applied to image recording equipment of the type using an electrostatographic process. The dielectric layer 2a of the belt 2 is implemented as a dielectric film which is 40 μm thick, while the conductive layer 2b underlying the dielectric layer 2a is formed by the evaporation of aluminum to a thickness of 10 μm. The belt 2 is movably passed over the drive roller 4' and support roller 4. The dielectric 2a has a volume resistivity of $10^8$ Ω·cm. The support roller 4 is made of metal and connected to ground. The electrode in the form of a roller 3 contacts the outer periphery of the belt 2 in the position where the belt 2 is passed over the support roller 4. The AC power source 5 applies an alternating voltage of ±2 kV and 60 Hz to the electrode 3. The drive roller 4' drives the belt 2 at a constant speed of 120 mm/sec as indicated by an arrow. The position for feeding the paper sheet 1 to the belt 2 is located downstream of the position where the electrode 3 contacts the belt 2. The belt 2 transports the paper sheet 1 over a distance of 240 mm. The AC power source 5 applies the alternating voltage to the belt 2 before the paper sheet 1 reaches the surface of the belt 2, whereby a charge density pattern is formed at the pitch of 2 mm on the surface of the belt 2. The paper sheet 1 is fed to the belt 2 at the paper feeding position to be retained and transported by the belt 2. Since the overlying layer 2a of the belt 2 has a medium resistance, the charge density pattern will have been attenuated to less than one half at the sheet separating position, promoting easy separation of the paper sheet 1. The paper sheet 1 separated from the belt 2 is fed to an image transfer station so as to transfer a toner image from a photoconductive element to the paper sheet 1.

In Example III, the only requisite with the paper feeding position is that it be located downstream of the position where the electrode 3 contacts the belt 2, because the conductive layer of aluminum 2b underlies the dielectric layer 2a. The belt 2 exerts a sufficient retaining force even in a hot and humid environment.

The embodiments described above may be implemented not only as a device for feeding the paper sheet 1 but also as a transport belt of an ADF, as will be described hereinafter.

EXAMPLE IV

Figure 11:
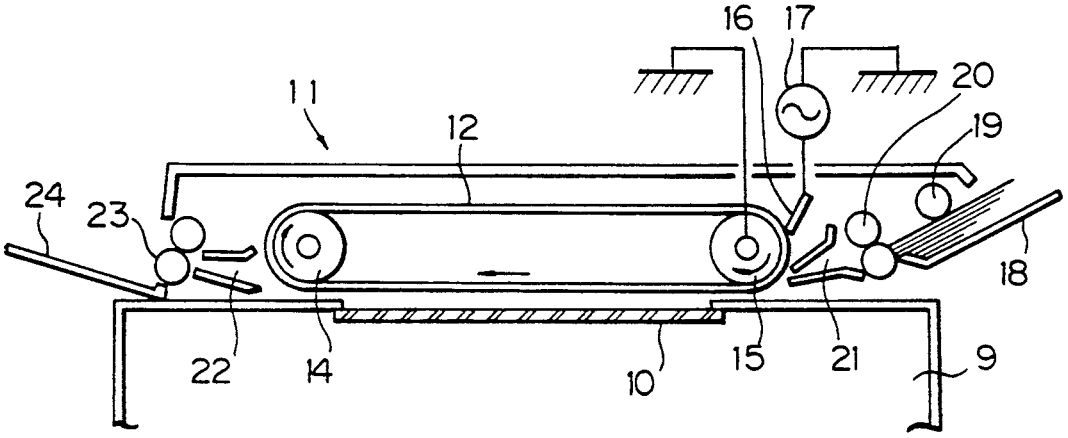
FIG. 11 is a sectional side elevation of an ADF to which the illustrative embodiments are applicable.

As shown in FIG. 11, an ADF 11 is mounted on the top of a copier 9 and covers the upper surface of a glass platen 10 of the copier 9. The belt 12 is comprised of a dielectric sheet such as a PET film and passed over a drive roller 14 and a driven roller 15. A part of the belt 12 which faces the glass platen 10 extends in a horizontal plane and strictly parallel to the glass platen 10. A clearance exists between the outer surface of the lower run of the belt 12 and the upper surface of the glass platen 10 and is dimensioned at least greater than the maximum thickness of documents usable with the copier 9.

A charge pattern forming unit 16 is held in contact with the belt 12 adjacent to the driven roller 15. An AC power source 17 applies an AC voltage to the charge pattern forming unit 16. The driven roller 15 also plays the role of a counter electrode. Documents stacked on a table 18 are fed one by one toward the belt 12 via a pick-up roller 19, transport roller 20, and an inlet guide 21. The document is fed to the belt 12 at a position downstream of the charge pattern forming unit 16 with respect to the direction of rotation of the belt 12 and in a range where the belt 12 is passed over the roller 15. The charge pattern forming unit 16 and AC power source 17 cooperate to form a charge density pattern of V/A mm (V and A being the moving speed of the belt 12 and the frequency of the AC voltage, respectively). For the reasons stated earlier, the document is electrostatically urged against and transported by the belt 12. Since the clearance between the glass platen 10 and the belt 12 is greater than the maximum thickness of documents, the belt 12 surely transports the document to a predetermined position while preventing if from rubbing against the glass platen 10. After the document has been illuminated, it is driven out of the glass platen 10 and, at the position where the drive roller 14 is located, separated from the belt 12 by curvature. Then, the document is discharged to a tray 24 via an outlet guide 22 by a discharge roller.

When use is made of a document in the form of a book, the operator will raise the ADF 11, put the document on the glass platen 10 by hand, and then lower the ADF 11 to use it as a cover plate or, alternatively, use an extra cover plate, as usual.

The clearance existing between the glass platen 10 and the document is extremely small and sufficiently covered by the depth of field of a lens, so that the copier is free from an out-of-focus problem. Nevertheless, the position of a lens included in optics may be finely adjusted depending on the thickness of documents.

EXAMPLE V

Figure 12:
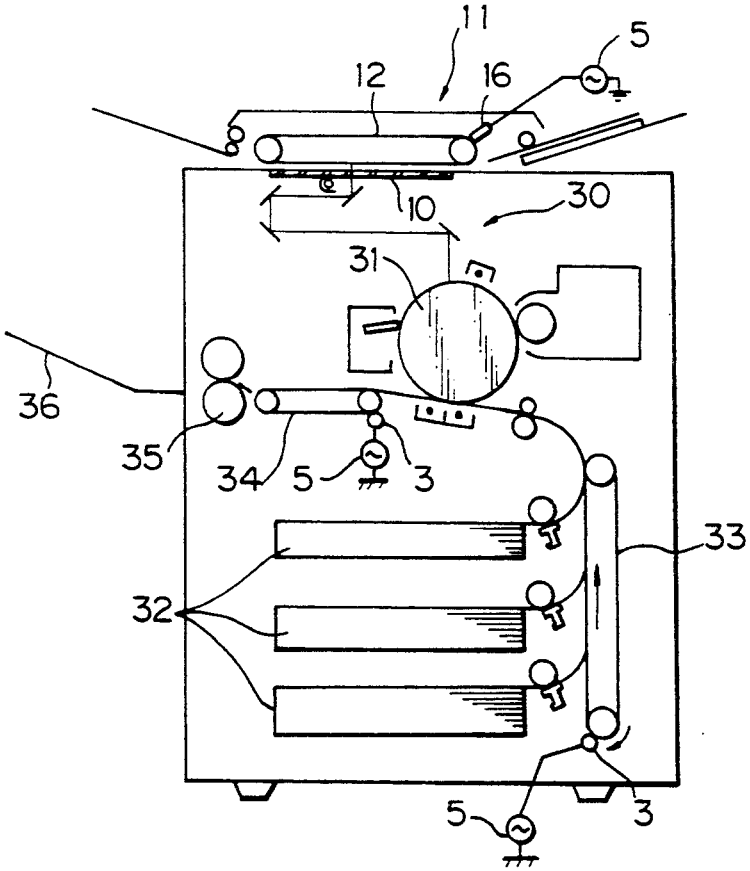
FIG. 12 is a section schematically showing the overall construction of an electrophotographic copier implemented by any of the illustrative embodiments.

FIG. 12 shows a specific construction of a black-and-white or a monocolor copier incorporating the paper sheet transport belt and document transport belt of any of the illustrative embodiments. As shown, the copier has the ADF 11 which feeds a document to the glass platen 10. The ADF 11 has the document transport belt 12 having any one of the configurations described hereinabove. The document fed to the glass platen 10 is illuminated. A reflection from the document is focused onto a photoconductive drum 31 by optics 30 to form a latent image on the drum 31. The latent image is developed by a conventional electrophotographic process to become a toner image. Three sheet cassettes 32 are removably loaded in a lower part of the copier. A paper sheet fed from any one of the sheet cassettes 32 is transported to the drum 31 by a vertically extending transport belt 33 to which any one of the illustrative embodiments is applied. After the toner image has been transferred from the drum 31 to the paper sheet, the paper sheet is conveyed to a fixing roller 35 by a transport belt 34 to which any one of the illustrative embodiments is also applied. The paper sheet coming out of the fixing roller 35 is driven out of the copier to a tray 36. The AC power source 5 feeds an alternating voltage to the belts 12, 33 and 34 via the electrodes 16 and 3.

It is to be noted that the present invention is also applicable to a variety of dielectric members other than paper sheets, documents or similar sheet members, so long as they have a broad flat surface and can be supported at such a surface.

EXAMPLE VI

Figure 13:
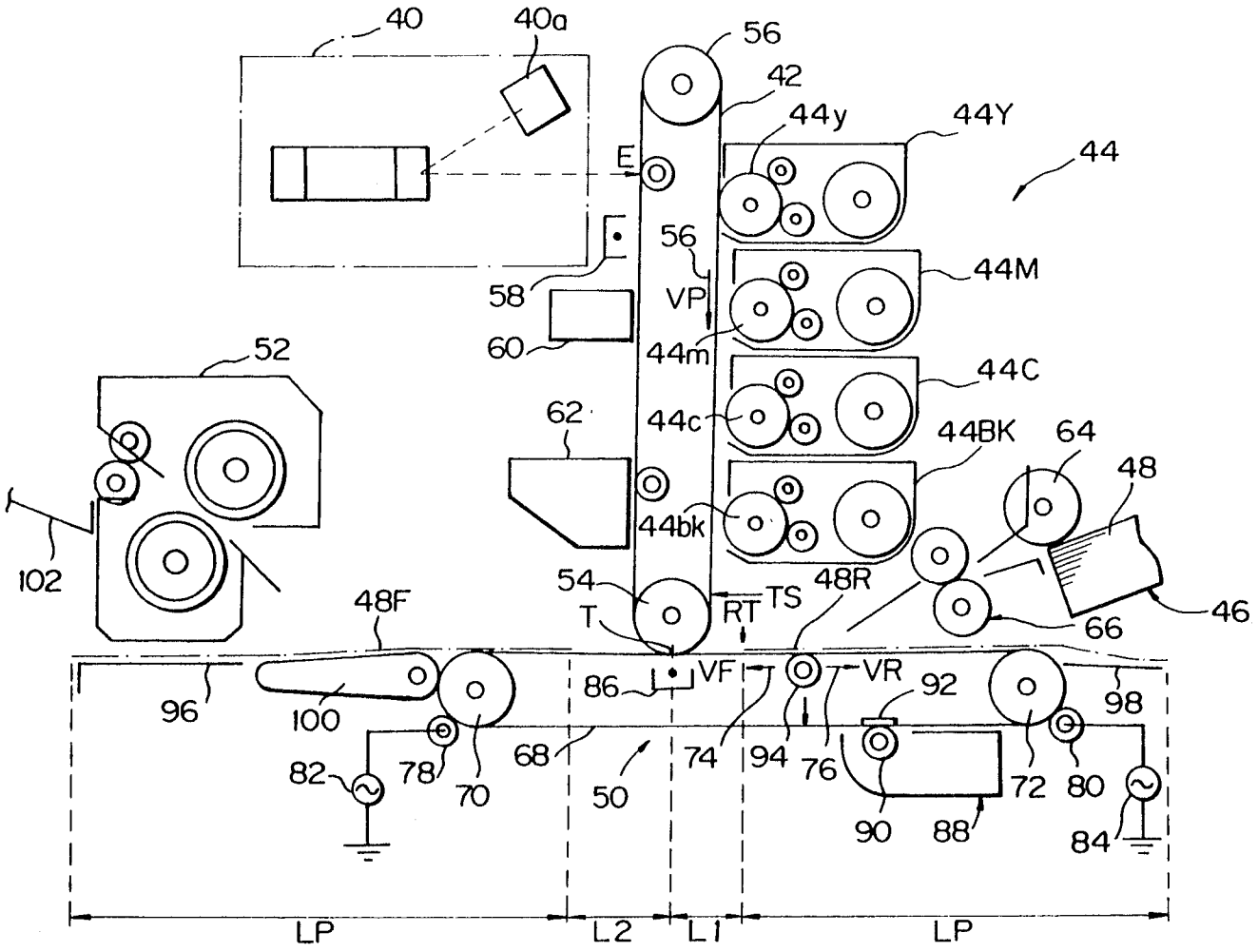
FIG. 13 is a section showing an electrophotographic color copier implemented by any of the illustrative embodiments.
Figure 14:
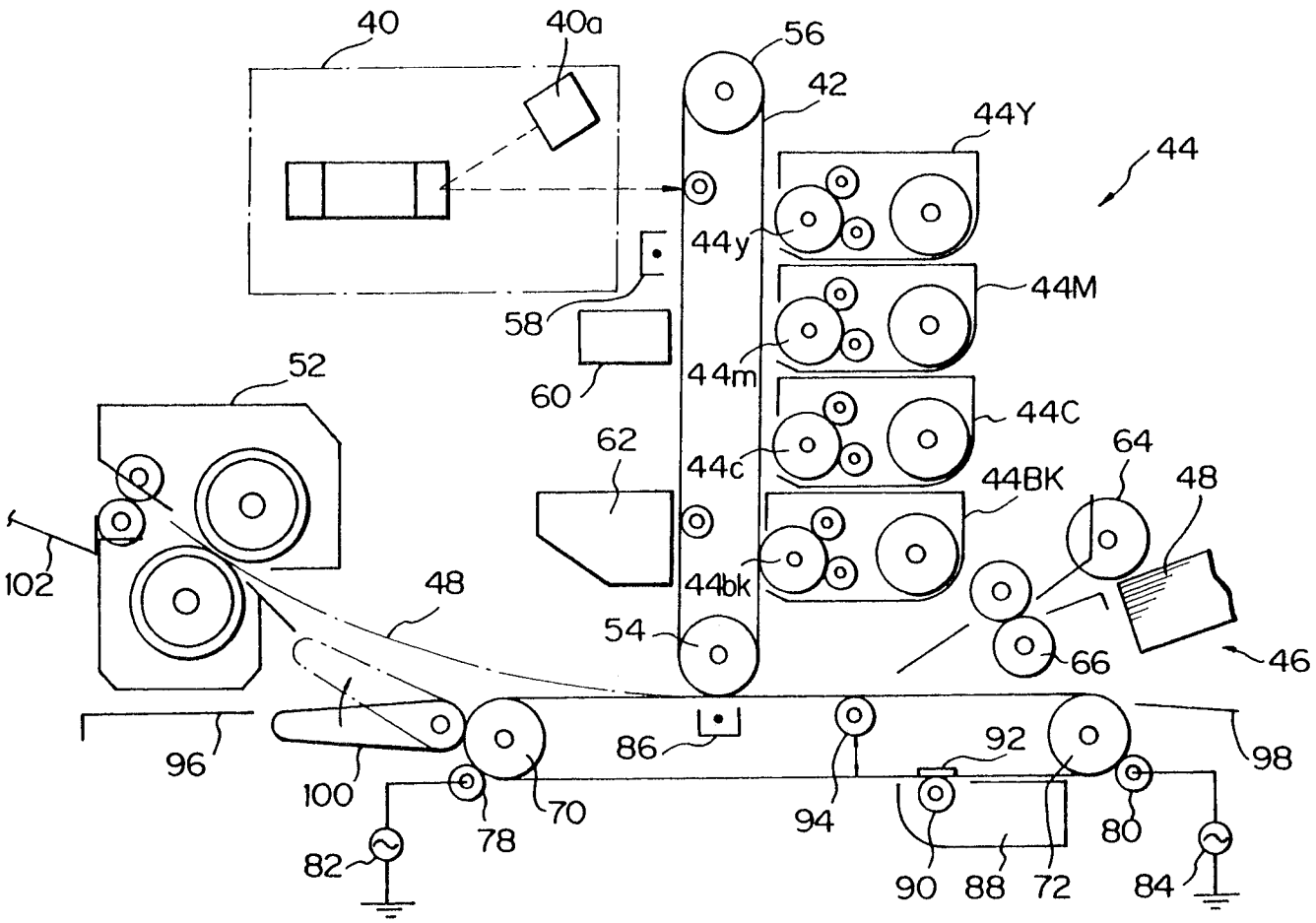
FIG. 14 is a section showing the copier of FIG. 13 in an operative condition.

Referring to FIGS. 13 and 14, a specific construction of a color copier implemented by any of the illustrative embodiments is shown. As shown, the copier has an optical writing unit 40, a photoconductive element in the form of a belt 42 which serves as an image carrier, a developing unit 44 for developing a latent image formed on the belt 42 by the writing unit 40, a paper feed unit 46 for feeding paper sheets 48, a transfer unit 50 for transferring a developed image from the belt 42 to a paper sheet 48, and a fixing unit 52 for fixing the image on the paper sheet 48. The belt 42 is passed over a drive roller 54 and a driven roller 56 and driven by the roller 54 at a speed VP in a direction indicated by an arrow 56. The developing unit 44 is made up of a yellow developing unit 44Y having a developing roller **44*y*, a magenta developing unit 44M having a developing roller 44*m*, a cyan developing unit 44C having a developing roller 44*c*, and a black developing unit 44BK having a developing roller 44*bk*. A charging unit 58, a discharging unit 60 and a cleaning unit 62 are arranged around the belt 42. A feed roller 64 feeds the paper sheets 48 one by one from the paper feed unit 46. Then, the paper sheet 48 is driven by a register roller pair 66 to a transfer position T which is defined by the transfer unit 50**.

The transfer unit 50 to which any of the embodiments is applicable has a transfer belt 68 which plays the role of paper transporting means and corresponds to the dielectric belt 2. Passed over a drive roller 70 and a driven roller 72, the belt 68 is reversibly driven by the roller 70 at a speed VF in a direction indicated by an arrow 74 or at a speed VR in a direction indicated by an arrow 76. The drive and driven rollers 70 and 72 each corresponds to the support roller 4. Counter electrodes 78 and 80 are respectively associated with the rollers 70 and 72, and each corresponds to the electrode 2. Power sources 82 and 84 each corresponding to the AC power source 5 or 5' apply AC voltages to the electrodes 78 and 80, respectively. Further, the transfer unit 50 has a transfer charger 86 located at the transfer position T, and a belt cleaner 88 having a roller 90 and a counter electrode 92. A roller 94 places the belt 68 into or out of contact with the drive roller 54, as needed. Flat paper guides 96 and 98 guide respectively the leading edge and the trailing edge of the paper sheet 48. A selector 100 switches over the path along which the paper sheet 48 is to be transported. The reference numeral 102 designates a copy tray.

Figure 15:
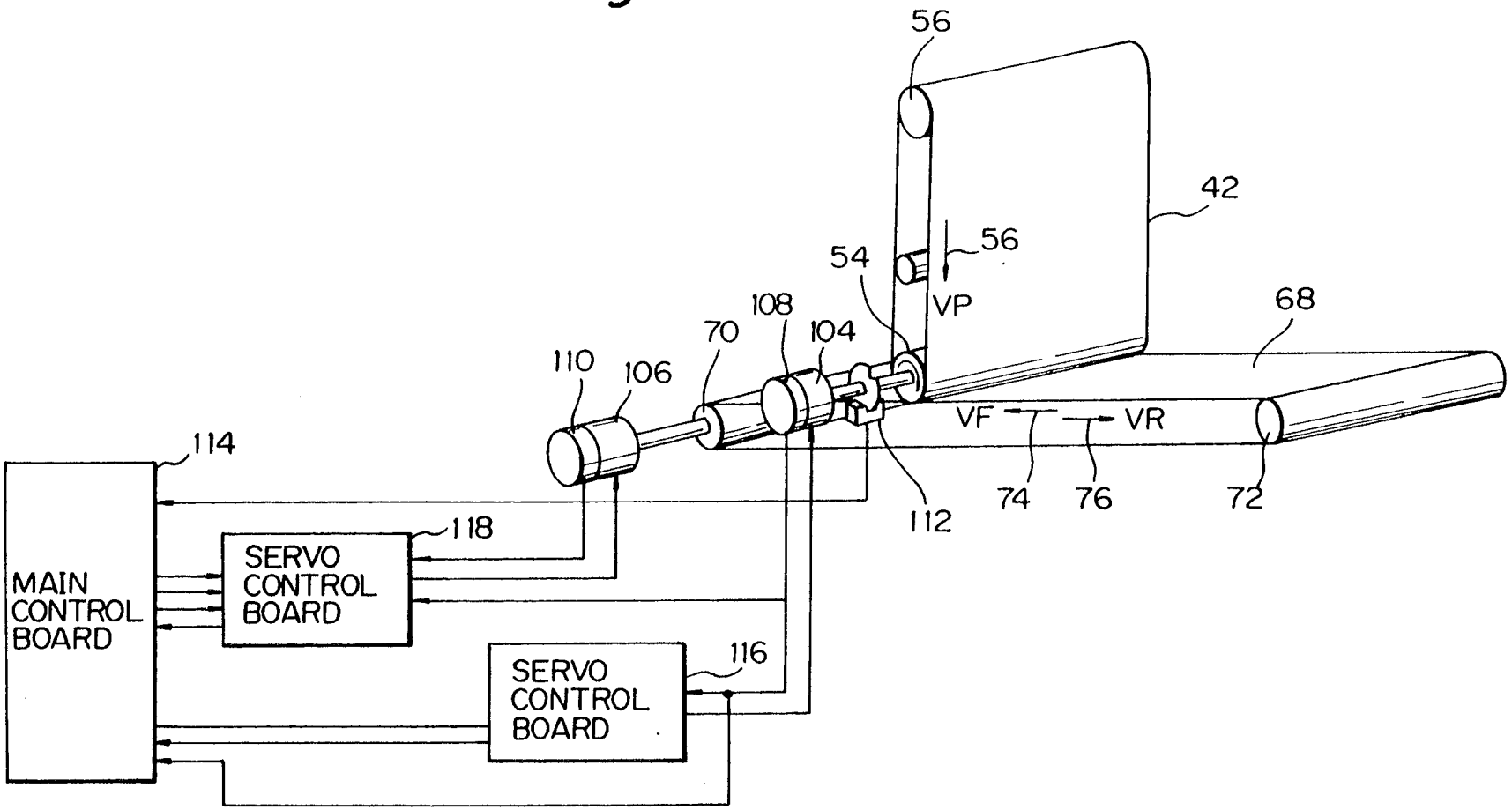
FIG. 15 shows a drive control system associated with a photoconductive belt and a transfer belt included in the copier of FIGS. 13 and 14.

FIG. 15 shows a control system for controllably driving the belts 42 and 72 of the above-stated color copier. As shown, the drive rollers 54 and 70 are driven by motors 104 and 106, respectively. Encoders 108 and 110 are associated with the motors 104 and 106, respectively. A one-rotation sensor 112 is also associated with the motor 104 and generates one pulse every time the roller 54 completes one rotation. Servo control boards 116 and 118 are connected to a main control board 114 and control the motors 104 and 106, respectively.

Figure 16A:
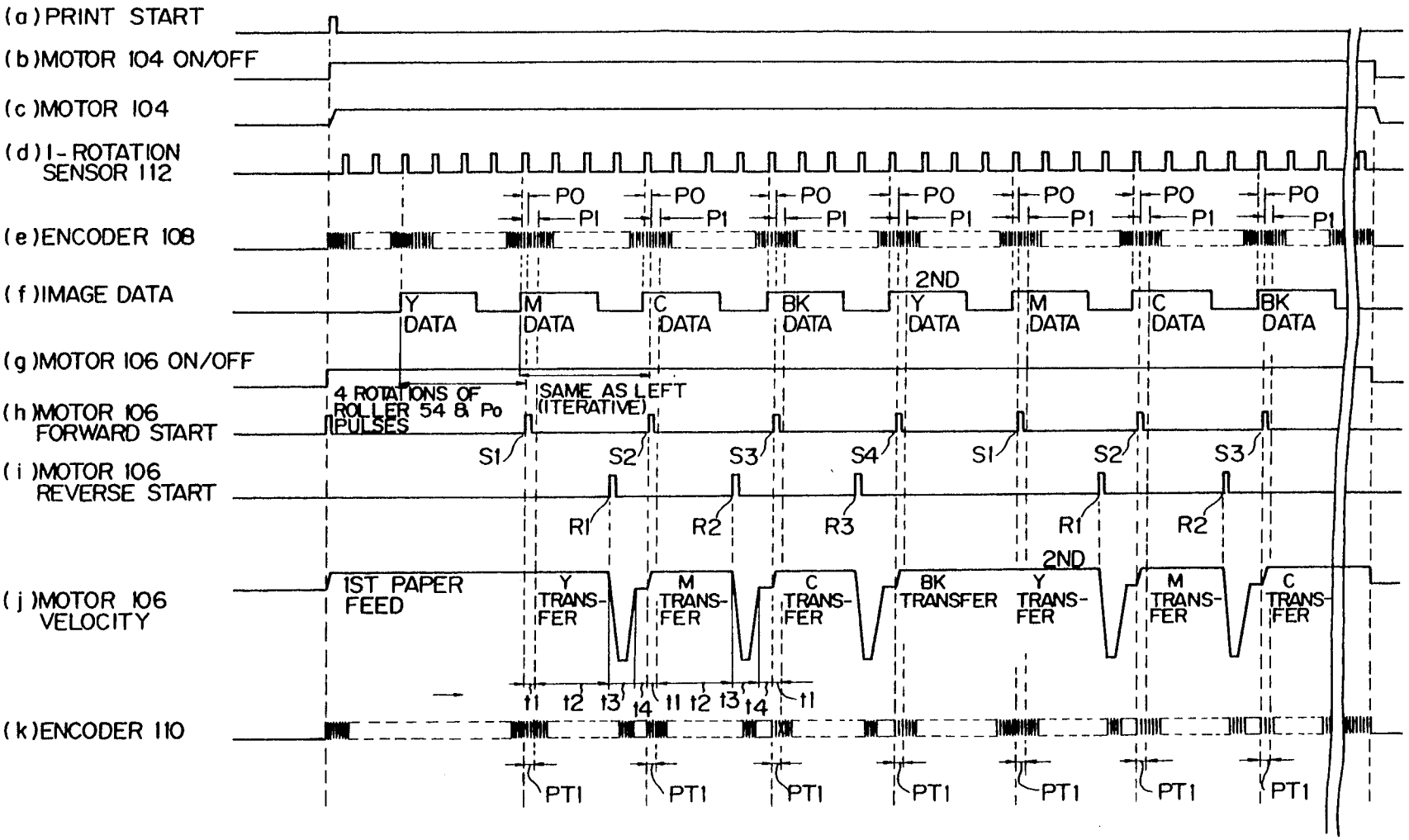
FIGS. 16A and 16B are timing charts demonstrating a specific operation of the control system shown in FIG. 15.
Figure 16B:
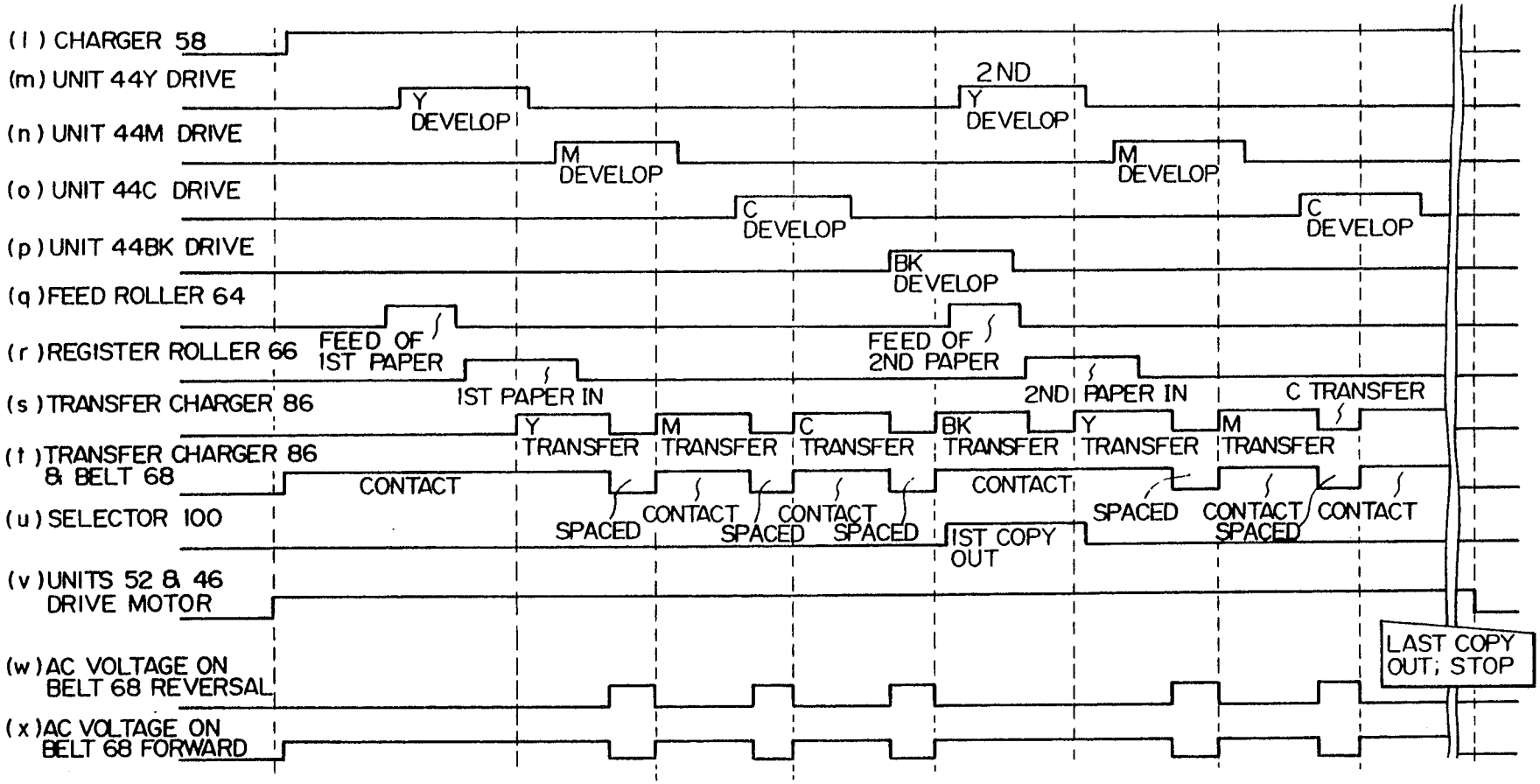

A specific operation of the color copier will be described with reference to FIG. 16. As shown in FIG. 16, (*a*), when a print start key, not shown, provided on the copier is turned on, the motor 104 causes the drive roller 54 into clockwise rotation and thereby drives the photoconductive belt 42 at a linear velocity VP in a direction indicated by an arrow 56 in FIGS. 13 and 15. At the same time, the motor 106 starts rotating forward, as shown in FIG. 16, (*g*), (*h*) and (*j*). As a result, the transport or transfer belt 68 is caused into movement at a linear velocity VF in a direction indicated by an arrow 74. At this instant, the linear velocities VP and VF are equal to each other.

The belt 42 is discharged by the discharging unit 60 and then uniformly charged by the charging unit 58, under the following conditions.

(1) The discharging unit 60 reduces the surface potential of the belt 42 whose surface has been cleaned by the cleaning unit 62 to substantially zero volts either by light or by corona discharge.

(2) In the case of a negative-to-positive process, a toner deposits in non-charged areas of the belt 42. Hence, a prerequisite is that the entire surface of the belt 42 be uniformly charged by the charging unit 58.

(3) Corona discharge effected by the charging unit 58 generates some ozone. Although such ozone decomposes shortly after the stop of discharge, it is likely to adversely effect the surface of the belt 42 and thereby render an image unclear. It is therefore desirable to blow air from behind the charger 58 or suck air by use of a fan or similar implementation, not shown.

As shown in FIG. 16, (*d*), the one-rotation sensor 112 mounted on the shaft of the drive roller 54 generates one pulse every time the roller 54 rotates one full rotation. When the one-rotation sensor 112 generates the third pulse, a semiconductor laser 40*a* included in the writing unit 40 begins to operate. Of course, the optical writing unit 40 may be implemented by an LED array or an LCD array in place of the semiconductor laser 40*a*.

To begin with, the color copier starts optically writing images represented by image data associated with colors Y (yellow), M (magenta), C (cyan) and BK (black). Specifically, a color image reader, for example, reads blue, green and red separated light components, and then calculation is performed on the basis of the intensity levels of the individual light components to produce the image data Y, M, C and BK. Alternatively, use may be made of image data outputted by any other color image processing system such as a color facsimile transceiver, word processor, or personal computer, in which case an exclusive interface will be incorporated.

Usually, the developing units 44Y, 44M, 44C and 44BK each is positioned such that the developing roller 44*y*, 44*m*, 44*c* or 44*bk* associated therewith is spaced apart from the surface of the belt 42. Immediately before a latent image to be developed by any one of the developing rollers 44*y* to 44*bk* reaches the roller and immediately after the former has moved away from the latter, only the developing unit having the roller of interest is urged to the left as viewed in FIG. 13 to a position where the roller contacts the belt 42 by a predetermined amount. At the same time, the roller of interest and portions which contribute to the development are driven to validate the developing function of the associated developing unit, FIG. 16, (*m*) to (*p*).

In this example, a latent image represented by yellow image data is formed first on the photoconductive belt 42. As shown in FIG. 16, (*m*), the developing unit 44Y is placed in contact with the belt 42 to develop the yellow image. This is followed by an image transferring step. The roller 94 is movable up and down to bring the tranfer belt 68 into and out of contact with the photoconductive belt 42 at the transfer position T. On the start of a printing operation, the transfer belt 68 is moved in the direction 74, and then the roller 94 is raised to urge the belt 68 against the photoconductive belt 42, FIG. 16, (*t*). At a predetermined timing, the feed roller 64 feeds a paper sheet 48. The paper sheet 48 is further driven by the register roller pair 66 such that it will be caused into register with the image formed on the belt 42. The paper sheet 48 so driven by the register roller pair 66 advances along the belt 68. At this time, the belt 68 has been uniformly discharged over the entire surface thereof and cleaned by the belt cleaner 88.

When the leading edge of the developed yellow image arrives at a position TS preceding the transfer position T, i.e., at a time S1 shown in FIG. 16, (*h*), a forward start signal is fed to the servo control board 118 which is assigned to the motor 106 for driving the transfer belt 68. At the time S1, the motor 106 has already been rotated in the forward direction and, therefore, continues the forward rotation, FIG. 16, (*j*). Further, at the time S1, the leading edge of the paper sheet 48 substantially arrives at a position RT preceding the transfer position T by a distance L1, and the leading edge of the yellow image on the belt 42 substantially arrives at the position TS preceding the transfer position T by the distance L1. In the specific operation shown in FIG. 16, at the time S1, the drive roller 54 associated with the photoconductive belt 42 has just completed four rotations after the start of writing of the yellow image data, and the encoder 108 of the motor 104 has just outputted $P_0$ pulses, FIG. 16, (*d*), (*e*), (*f*) and (*h*). During this period of time, the belt 42 has moved a distance corresponding to the distance between the writing position of the writing unit 40 and the position TS. On the lapse of a period of time t1 since the time S1, FIG. 16, (*h*), the leading edges of the yellow image and paper sheet 48 both have moved the distance L1 to the transfer position T. Thereafter, the transfer charger 86 transfers the yellow image to the paper sheet 48. At the time t1, the encoders 108 and 110 have generated P1 pulses and PT1 pulses, respectively, FIG. 16, (*e*) and (*k*). Here, P1 and PT1 are equal to each other if the resolutions of the encoders 108 and 110, i.e., the distances per pulse which the associated belts move are the same. On the other hand, if the resolutions are in a ratio $\alpha$, P1 and PT1 each will have a value associated with the coefficient $\alpha$. The following description will concentration on the condition P1=PT1.

As the transfer of the yellow image to the paper sheet 48 proceeds, the leading edge of the sheet 48 is separated from the transfer belt 68 and advances toward the paper guide 96 over the selector 100 which is held in the solid line position (FIG. 13). As the image transfer further proceeds until the trailing edge of the sheet 48 has moved away from the transfer position T by a distance L2, i.e., when the paper sheet 48 has moved a distance [L1+LP (paper size)+L2] since the time S1 (time (t1+t2); the sheet 48 having been stopped at a dash-and-dot line position 48F), the motor 106 is reversed by a reverse signal, FIG. 16, (*i*) and (*j*). Before the reversal of the motor 106, the roller 94 is lowered to release the belt 68 from the belt 68. By the reversal of the motor 106, the belt 68 and paper sheet 48 are returned quickly to the right, as indicated by the arrow 76, at a speed VR which is higher than VF. While the belt 68 is so returned, the power source 82 applies an AC voltage to the electrode 78. As a result, the electrode 78 forms a charge density pattern on the belt 68 in cooperation with the counter electrode 78, FIG. 16, (*w*), thereby exerting an attracting force on the leading edge portion of the paper sheet 48 which is spaced apart from the belt 68. At this instant, during a short returning time $t_3$, the paper sheet 48 is returned to the right (arrow 76) by the same distance as the distance which it moved to the left (arrow 74) during the time (t1+t2). Then, the trailing edge of the paper sheet 48 is separated from the belt 68 and advances toward the paper guide 98. On accurately returning over the predetermined distance, the paper sheet 48 is brought to a stop at a dash-and-dot line position 48R where its leading edge is located at the position RT. In this position, the paper sheet is caused to wait a period of time t4 for the transfer of an image of the second color, i.e. a magenta image.

While the transfer of the yellow image to the paper sheet 48 is under way, the magenta image is formed on the photoconductive belt 42. Specifically, a latent image representative of magenta data begins to be formed on the belt 42 when the drive roller 54 completes an integral number of rotations after the start of writing of the yellow image data, i.e. four rotations in FIG. 13. Before the magenta image area reaches the developing unit 44Y, the unit 44Y is released from the belt 42 and then deactivated. Instead, the developing unit 44M is placed into contact with the belt 42 before the magenta image area reaches it, FIG. 16, (*n*). As a result, only a latent image representative of a magenta image is developed by the developing unit 44M.

Assume that the leading edge of the developed magenta image has arrived at the position TS. More specifically, assume that after the start of writing of the magenta image data, the drive roller 54 has completed four rotations and the encoder 108 associated with the motor 104 has outputted $P_0$ pulses (time S2 in FIG. 16, (*h*)). Then, a forward start signal is fed to the servo control board 118 assigned to the motor 106. At the same time or shortly after the delivery of the forward start signal, the roller 94 starts moving upward and, at least before the leading edge of the paper sheet 48 arrives at the transfer position T, causes the belt 68 into contact with the belt 42. At the time S2 when the forward rotation begins, the power source 84 applies an AC voltage to between the electrode roller 80 and the driven roller or counterelectrode 72 for forming a charge density pattern, FIG. 16 (*x*). As a result, an attracting force acts on the leading edge portion of the paper sheet 48 which is spaced apart from the belt 68. At the start of printing, the power source 84 also applies an AC voltage in order to discharge the belt 68, FIG. 16 (*x*).

Before the time t1 expires after the time S2, the encoder 108 of the motor 104 produces P1 pulses and the photoconductive belt 42 moves a distance L1, as has been the case with the yellow image. Hence, the paper sheet 48 is accelerated from zero speed to VF (=VP) before the time t1 expires. This also causes the leading edge of the paper sheet 48 to move the distance L1 during the period of time t1, whereby the second or magenta image coincides with the first or yellow image on the paper sheet 48.

Thereafter, the above-described sequence of steps is repeated. Specifically, the magenta image is transferred to the paper sheet 48, the sheet 48 is quickly returned, cyan data is written, the resultant cyan latent image is developed, the developed cyan image is transferred to the sheet 48, black image data is written, the resultant black latent image is developed, and then the developed black image is transferred to the sheet 48.

A reference will be made to FIG. 14 for describing a procedure which follows the transfer of the black image to the paper sheet 48. When a black image transferring step is reached, the selector 100 is shifted to a dash-and-dot line position. In this condition, the paper sheet 48 undergoing the transfer of the black image is steered toward the fixing unit 52 by the selector 100. Even after the paper sheet 48 has been subjected to the image transfer up to the trailing edge thereof, the motor 106 associated with the transfer belt 68 continuously rotates forward to move the sheet 48 to the left. Consequently, the paper sheet or color copy 48 is driven out of the copier onto the copy tray 102, FIG. 16, (*j*), (*u*) and (*v*). When the copier is operated in a repeat mode as shown in FIG. 16 specifically, the yellow image data is written again after the black image data, while the movement of the paper sheet 48 and that of the transfer belt 68 are controlled in the previously stated manner. The cleaning unit 62 removes toner particles remaining on the photoconductive belt 42 after the image transfer, and then the discharging unit 60 dissipates the charge remaining on the belt 42. The belt 42 so cleaned and discharged is moved toward the charging unit 58. Finally, the last color copy is driven out of the copier onto the tray 102 while, after the belts 42 and 68 have been cleaned, the copier is restored to the initial conditions.

It is to be noted that the image forming sequence Y, M, C and BK and the order of image forming units 44Y to 44BK shown and described in Example VI are only illustrative and not limitative. In Example VI, the latent images each being associated with a particular color are optically written by a laser in response to digitally processed image data. Alternatively, ordinary analog optical images available with an electrophotographic copier may be focused one after another on the position E of the photoconductive belt 42 under predetermined timing and position control. When only two or three of four different colors Y, M, C and BK are desired, the various sections of the copier will be so controlled as to repeat the image forming and transferring operations twice or three times. In the event of monocolor recording, desired one of the developing units 44Y to 44BK is held in contact with the photoconductive belt 42, the transfer belt 68 is held in contact with the belt 42, and the selector 100 is so positioned as to steer all the paper sheets 48 toward the fixing unit 52. The rate at which copies are produced, therefore, is 4/3 time, twice and four times higher in the event of three-color recording, two-color recording and monocolor recording, respectively, than in the event of four-color recording. Of course, the copier is also operable with the combination of any desired colors other than the four colors stated above, e.g. blue, green and red.

Operation timings of the transfer belt 68 and paper sheet 48 will be described in more detail.

Figure 17:
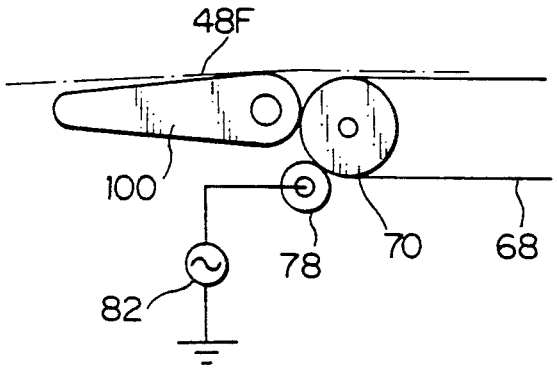
FIGS. 17 and 18 each shows a particular condition of a sheet relative to the transfer belt.
Figure 18:
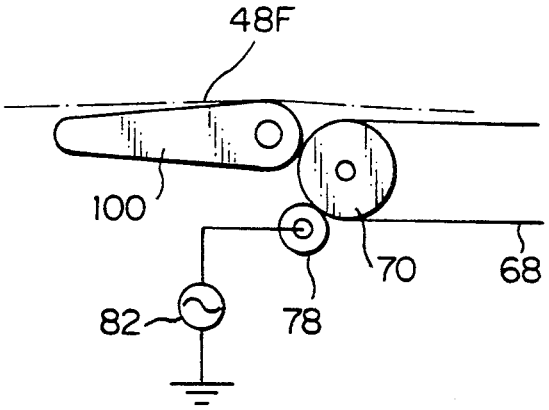

Just after the transfer of the yellow image to the paper sheet 48, the sheet 48 is located in the position 48F, FIG. 13. In this position, the portion of the paper sheet 48 lying on the transfer belt 68 is attracted onto the belt 68 by the transfer current of the transfer charger 86. However, no attracting force acts on the other portion of the paper sheet 48 which is spaced apart from the belt 68. As the drive roller 70 associated with the belt 68 is reversed, the belt 68 is moved as indicated by the arrow VR. At this instant, the AC voltage from the AC power source 82 is applied to between the electrode 78 and the drive roller or counter electrode 70. As a result, slit-like charge density pattern is formed on the belt 68 to in turn generate a non-uniform electric field. This electric field again attracts the portion of the paper sheet 48 which has been separated from the belt 68. For this purpose, a charge density pattern is formed with the drive roller 70 serving as a counter electrode, as shown in FIG. 13. However, the attraction due to such a non-uniform electric field is not attainable unless the belt 68 moves while causing the paper sheet 48 to contact the periphery of the drive roller 70. FIGS. 17 and 18 show constructions with which the attracting force is attainable and is not attainable, respectively.

To transfer the magenta image after the yellow image, the transfer belt 68 is moved in the direction VF, the paper sheet 48 is held in a halt at the position 48R, and the trailing edge portion of the sheet 48 is spaced apart from the driven roller 72. On the start of the transfer of the magenta image, the AC voltage from the AC power source 84 is applied to between the electrode 80 and the driven roller or counter electrode 72. This is successful in attracting the paper sheet 48 again, as at the driving side.

The non-uniform electric field developed as stated above uniformizes the potential in the leading edge portion of the paper sheet 48 having been separated from the belt 68 and again laid on the belt 68 and in the trailing edge portion of the same having remained on the belt 68 without being separated. As a result, an attracting force is maintained between the paper sheet 48 and the belt 68. Regarding the second color and successive colors, the trailing edge of the paper sheet 48 is attracted as during the backward movement.

Generally, a prerequisite with the sequential transfer of images of different colors as stated above is that a greater transfer current be supplied for the second transfer (second color) than for the first transfer (first color) so as to set up an equivalent electric field. This is because the first transfer increases the potential of the paper sheet and that of the transfer belt to a certain degree. Hence, when images of four different colors are sequentially transferred, a substantial current (about 1 milliampere in practice) is needed for the fourth color. By contrast, in Example VI shown and described, the electrodes 78 and 80 and AC power sources 82 and 84 allow the third and fourth colors to be transferred by a current equivalent to the current for transferring the second color.

EXAMPLE VII

Figure 19:
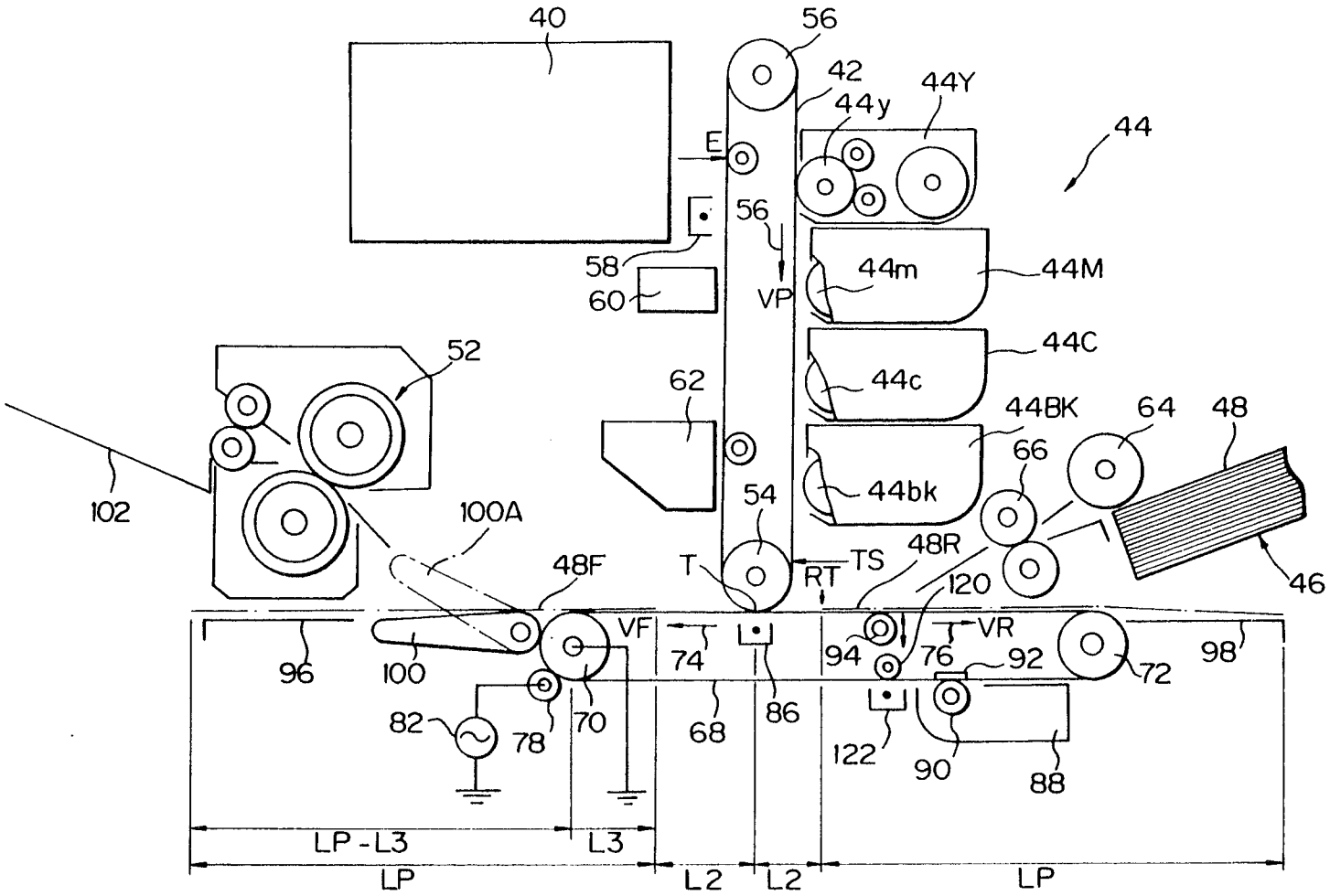
FIG. 19 is a section showing another electrophotographic color copier implemented by any of the illustrative embodiments.

FIG. 19 shows another color copier which is different from the copier of FIG. 13 in that a roller, or counter electrode for discharging, 120 and a corona charger for discharging 122 face each other with the intermediary of the transfer belt 68, and in that the roller 80 and AC power source 84 are omitted. The paper sheet 48 having a length LP and completing the forward movement lies on the paper guide 96 at the leading edge portion thereof, on the selector 100 at the intermediate portion thereof, and on the belt 68 at the trailing edge portion thereof whose length is L3. On the return of the paper sheet 48, the leading edge portion and the trailing edge portion lie on the belt 68 and the paper guide 98, respectively.

The timing for forming a charge density pattern on the transfer belt 68 is as follows. The paper sheet 48 carrying the image of the first color and returned has only the portion thereof whose length is L3 lying on the belt 68 and being effected by the attracting force due to the corona of the transfer charger 86. Hence, the portion of the paper sheet 48 spaced apart from the belt 68 and extending over a length (LP–L3) is not attracted. Even when the belt 68 is reversed to allow the portion of the paper sheet 48 having been separated from the belt 68 to join the belt 68 again, the attracting force which will act on such a portion is weak. On completion of the reversal, no attraction acts between the paper sheet 48 and the belt 68 in the waiting position 48R. As a result, the paper sheet 48 is dislocated relative to the belt 68 to prevent images from being transferred accurately one upon another. In the light of this, Example VII is constructed and arranged such that when the drive roller 70 is reversed to return the belt 68 at the speed VR, the AC voltage from the AC power source 82 is applied to between the roller 78 and the drive roller or counter electrode 70. Consequently, a positive and negative charge density pattern is formed in the portion of the belt 68 which corresponds to the length (LP–L3) of the paper sheet 48. The resultant non-uniform electric field attracts the portion of the paper sheet 48 having been separated from the belt 68 and having the length (LP–L3). The belt 68, therefore, retains the paper sheet 48 accurately thereon during the quick return.

If desired, the rollers 78 and 80 implementing the means for charging the belt 68 may be replaced with blades.

In summary, the present invention achieves various unprecedented advantages as enumerated below.

(1) A sheet member is surely electrostatically retained and transported by a simple construction without being dislocated.

(2) When the member to be transported is a paper sheet, a toner image is prevented from being brought out of register with the paper sheet. When it is a document, it is transported along a glass platen without rubbing against the latter, improving reliability and durability.

(3) Contamination of a belt and, therefore, the reproduction thereof on a copy is eliminated to improve the quality of reproductions.

(4) The size and cost of an apparatus is cut down.

(5) Durability and reliability are enhanced because an exclusive electrode forms a charge density pattern for retaining a sheet.

(6) A material which allows a charge density pattern to attenuate only slowly may be used to transport a plurality of sheets continuously. Alternatively, a material which allows a charge density pattern to easily attenuate is usable to promote the separation of a sheet.

Various modifications will become possible for those skilled in the art after receiving the teachings of the present disclosure without departing from the scope thereof.

What is claimed is:

1. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern;

the alternating voltage comprising an AC voltage.

2. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern;

the alternating voltage comprising a non-uniform alternating voltage.

3. A device for transporting a sheet member having a substantial flat surface, comprising:

an endless belt transporting member made of a dielectric for transporting the sheet member while holding the flat surface of the sheet member in contact with a surface of said transporting member;

an electrode held in contact with said transporting member for forming a charge density pattern on said surface of said transporting member;

a roller supporting said endless belt and located to face said electrode; and voltage applying means for applying an alternating voltage to said transporting member in order to form said charge density pattern;

wherein a position where the sheet member is fed to said endless belt is located downstream of a position where said roller faces said electrode with respect to an intended direction of movement of said endless belt and in a range where said endless belt contacts said roller.

4. A color image forming apparatus having a device for transporting a paper sheet in a reciprocating motion to transfer a plurality of developed color images from a image carrier to said paper sheet one upon another, said device comprising:

an endless transport belt made of a dielectric material for transporting the paper sheet to an image transfer position by retaining said paper sheet;

a pair of roller means for passing over and supporting said transport belt, said roller means comprising a drive roller for driving said transport belt in the reciprocating motion and a conductive roller connected to ground;

an electrode contacting said transport belt and facing said conductive roller with the intermediary of said transport belt for forming, when said transport belt is in a forward and a backward movement, a charge density pattern on a portion of said transport belt; and voltage applying means for applying an alternating voltage to said electrode to form said charge density pattern on said portion of said transport belt wherein said paper sheet remains uncharged.

5. A color image forming apparatus as claimed in claim 4, wherein a feed position lies in a range between a position downstream of a position where said electrode and said conductive roller contact with respect to an intended direction of movement of said transport belt and a position where said transport belt and said conductive roller contact.

6. A color image forming apparatus as claimed in claim 5, wherein a register roller means is arranged to feed the paper sheet to said feed position.

7. A color image forming apparatus as claimed in claim 4, wherein when said transport belt is moved in said forward movement and stopped at a predetermined position, a part of said paper sheet transported by said transport belt is separated from said transport belt, and when said transport belt is moved in said backward movement from said predetermined position, a charge density pattern is formed on said portion of said transport belt whereby said separated part of said paper sheet is attracted to said portion of said transport belt.

8. A color image forming apparatus as claimed in claim 7, further comprising a second electrode contacting said transport belt and facing said drive roller with the intermediary of said transport belt for forming, when said transport belt is in the forward and the backward movement, a charge density pattern on said portion of said transport belt, and second voltage applying means for applying an alternating voltage to said second electrode.

9. A color image forming apparatus as claimed in claim 8, wherein said paper sheet is transported in the forward movement by said transport belt and stopped at a first position and transported in the backward movement from said first position and stopped at a second position preceding said image transfer position by a predetermined distance.

10. A color image forming apparatus as claimed in claim 9, wherein a speed of said transport belt in the backward movement is higher than a speed of said transport belt in the forward movement.

11. A color image forming apparatus as claimed in claim 10, wherein said alternating voltage is an AC voltage.

12. A color image forming apparatus as claimed in claim 10, wherein said alternating voltage is a non-uniform alternating voltage.

13. A color image forming apparatus as claimed in claim 7, further comprising guide means provided at said predetermined position for guiding said part of said paper sheet and fixing means for fixing said transferred color images on said paper sheet.

14. A color image forming apparatus as claimed in claim 13, further comprising selector means for selecting one of said guide means and said fixing means to which said paper sheet is directed.

15. A color image forming apparatus as claimed in claim 7, further comprising moving means for bringing said transport belt into contact with said image carrier at the image transfer position in the forward movement to transfer the developed color images from the image carrier to said paper sheet and out of contact with the image carrier at the image transfer position in the backward movement.

16. A color image forming apparatus as claimed in claim 4, wherein said voltage applying means applies said alternating voltage to said electrode to charge opposite surfaces of said transport belt with a charge density pattern having alternating regions of charge of opposite polarity on each of said opposite surfaces, thereby producing a nonuniform electric field which electrostatically urges said paper sheet toward said transport belt.

17. A device for transporting a sheet member having a substantial flat surface, comprising:

a transporting member for transporting the sheet member while holding the flat surface of the sheet member in contact with a surface of said transporting member, said transporting member comprising an endless belt which is made of a dielectric and has a continuous solid layer;

an electrode held in contact with said transporting member for forming a charge density pattern on said surface of said transporting member; and voltage applying means for applying an alternating voltage to said electrode in order to form said charge density pattern wherein the sheet member remains uncharged.

18. A device as claimed in claim 17, further comprising a roller supporting said endless belt and located to face said electrode.

19. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern, said transporting member comprising an endless belt which comprises a conductive layer provided over an entire inner periphery of said endless belt, said conductive layer being connected to ground.

20. A device as claimed in claim 19, wherein the alternating voltage is an AC voltage.

21. A device as claimed in claim 19, wherein the alternating voltage is a non-uniform alternating voltage.

22. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern;

said transporting member comprising an endless belt which comprises a transport belt for transporting a document along a glass platen of a copier or similar equipment, said transport belt and a surface of the glass platen being spaced apart by a clearance which is greater than a maximum thickness of documents usable with the equipment.

23. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern;

said charge density pattern having a pitch of 0.1 mm to 20 mm.

24. A device for transporting a sheet member having a substantial flat surface, comprising:

a transporting member made of a dielectric for transporting the sheet member while holding the flat surface of the sheet member in contact with a surface of said transporting member;

an electrode held in contact with said transporting member for forming a charge density pattern on said surface of said transporting member; and voltage applying means for applying an alternating voltage to said electrode in order to form said charge density pattern;

the alternating voltage being higher than a charge starting voltage by at least 500 V in terms of peak-to-peak voltage.

25. A device as claimed in claim 24, wherein said transporting member has a volume resistivity which is such that a surface potential of said transporting member decreases to less than one half while said transporting member moves from a position where the alternating voltage is applied to said transporting member to a position where the sheet member is separated from said transporting member.

* * * * *